US007739764B2

(12) United States Patent
Zhang et al.

(10) Patent No.: US 7,739,764 B2
(45) Date of Patent: Jun. 22, 2010

(54) METHOD AND APPARATUS FOR MONITORING LOAD SIZE AND LOAD IMBALANCE IN WASHING MACHINE

(75) Inventors: Zheng Zhang, St. Joseph, MI (US); Tao Xie, St. Joseph, MI (US); Gregory M. Garstecki, St. Joseph, MI (US); Mark M. Xie, St. Joseph, MI (US); Scott D. Slabbekoorn, St. Joseph, MI (US); Ali R. Buendia, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1293 days.

(21) Appl. No.: 11/115,695

(22) Filed: Apr. 27, 2005

(65) Prior Publication Data

US 2006/0242768 A1 Nov. 2, 2006

(51) Int. Cl.
*D06F 33/02* (2006.01)

(52) U.S. Cl. ..... 8/159; 68/12.02; 68/12.04; 68/12.06

(58) Field of Classification Search ..... 8/159
See application file for complete search history.

(56) References Cited

U.S. PATENT DOCUMENTS

| | | | | |
|---|---|---|---|---|
| 6,640,372 | B2 | 11/2003 | Ciancimino et al. | |
| 6,998,812 | B2 * | 2/2006 | Kerner et al. | 318/648 |
| 2001/0052265 | A1 | 12/2001 | French et al. | |
| 2004/0154350 | A1 * | 8/2004 | Weinmann | 68/12.04 |
| 2004/0211009 | A1 * | 10/2004 | Murray et al. | 8/159 |

FOREIGN PATENT DOCUMENTS

| | | | |
|---|---|---|---|
| DE | 4038178 | A1 * | 6/1992 |
| EP | 1610144 | A2 | 12/2005 |
| GB | 2174513 | A * | 11/1986 |

OTHER PUBLICATIONS

The documents listed hereinabove were cited in the European Search Report EP 06250709.0 dated Nov. 23, 2006 received in connection with a European Application corresponding to the above-referenced U.S. application.

* cited by examiner

*Primary Examiner*—Michael Barr
*Assistant Examiner*—Jason P Riggleman
(74) *Attorney, Agent, or Firm*—Clifton G. Green; McGarry Bair PC

(57) ABSTRACT

A method of determining static and dynamic imbalance conditions in a horizontal axis washing machine utilizes a number of dynamic algorithms to automatically determine the total load size, the magnitude of any static load imbalance, and the magnitude of any dynamic load imbalance for any given load in a given washing machine based on power measurements from the washing machine motor obtained in predetermined speed profiles.

16 Claims, 24 Drawing Sheets

METHOD AND APPARATUS FOR MONITORING LOAD SIZE AND LOAD IMBALANCE IN WASHING MACHINE

BACKGROUND OF THE INVENTION

1. Field of the Invention

The present invention relates to a method and apparatus for detecting load size and detecting and correcting an unbalanced condition in the rotating drum of a washing machine using power information from a motor controller. It is particularly applicable to a washing machine having a drum on an axis other than vertical.

2. Description of the Related Art

Washing machines utilize a generally cylindrical perforated basket for holding clothing and other articles to be washed that is rotatably mounted within an imperforate tub mounted for containing the wash liquid, which generally comprises water, detergent or soap, and perhaps other constituents. In some machines the basket rotates independently of the tub and in other machines the basket and tub both rotate. In this invention, the rotatable structure is referred to generically as a "drum", including the basket alone, or the basket and tub, or any other structure that holds and rotates the clothing load. Typically, an electric motor drives the drum. Various wash cycles introduce into the clothing and extract from the clothing the wash liquid, usually ending with one or more spin cycles where final rinse water is extracted from the clothes by spinning the drum.

It is common to categorize washing machines by the orientation of the drum. Vertical-axis washing machines have the drum situated to spin about a vertical axis relative to gravity. Horizontal-axis washing machines have the drum oriented to spin about an essentially horizontal axis, relative to gravity.

Both vertical and horizontal-axis washing machines extract water from clothes by spinning the drum about their respective axes, such that centrifugal force extracts water from the clothes. Spin speeds are typically high in order to extract the maximum amount of water from the clothes in the shortest possible time, thus saving time and energy. But when clothing and water are not evenly distributed about the axis of the drum, an imbalance condition occurs. Typical spin speeds in a vertical axis washer are 600-700 RPM, and in a horizontal axis washer at 1100 or 1200 RPM. Moreover, demand for greater load capacity fuels a demand for larger drums. Higher spin speeds coupled with larger capacity drums aggravates imbalance problems in washing machines, especially in horizontal axis washers. Imbalance conditions become harder to accurately detect and correct.

As the washing machine drum spins about its axis, there are generally two types of imbalances that it may exhibit: static imbalance and dynamic imbalance. FIGS. 1-4 illustrate schematically different configurations of imbalance in a horizontal axis washer comprising a drum 10 having a horizontal geometric axis 12 spinning at angular speed ω. The drum 10 is suspended for rotation within a cabinet 14 having a front 16 (where access to the interior of the drum is normally provided) and a back 18. A drive point 19 (usually a motor shaft) is typically located at the back 18.

FIGS. 1(*a*) and (*b*) show a static imbalance condition generated by a static off-balance load. Imagine a load 20 on one side of the drum 10, but centered between the front 16 and the back 18. A net moment torque t causes the geometric axis 12 to rotate about the axis of rotation 22 of the combined mass of the drum 10 and the load 20, resulting in displacement d of the drum 10. This displacement, if minor, is often perceived as a vibration at higher speeds. The suspension system is designed to handle such vibration under normal conditions. Static imbalances are detectable at relatively slow speeds such as 85 or 90 RPM by measuring the magnitude of the load imbalance (MOB) because static imbalance loads are correlated to the MOB.

Dynamic imbalance is more complex and may occur independently of the existence of any static imbalance. FIGS. 2-4 illustrate several different conditions where dynamic imbalances exist. In FIGS. 2(*a*) and (*b*), imagine a dynamic off balance load of two identical masses 30, one on one side of the drum 10 near the front 16 and the other near the back 18. In other words, the masses 30 are on a line 32 skewed relative to the geometric axis 12. The net moment torque $t_1$ about the geometric axis 12 is zero, so there is no static imbalance. However, there is a net moment torque $t_2$ along the geometric axis 12, so that the drum will tend to wobble about some axis other than the geometric axis. If the moment is high enough, the wobble can be unacceptable.

FIG. 3(*a*) and (*b*) illustrates a combined static and dynamic imbalance caused by a front off-balance load. Imagine a single load 40 in the drum 10 toward the front 16. There is a net moment torque $t_1$, about the geometric axis 12 from centrifugal force F, resulting in a static imbalance. There is also a moment torque $t_2$ along the geometric axis 12, resulting in a dynamic imbalance. The resulting motion of the drum is a combination of displacement and wobble.

FIGS. 4(*a*) and (*b*) illustrates a combined static and dynamic imbalance caused by a back off-balance load. Imagine a single load 50 in the drum 10 toward the back 18. There is a net moment torque $t_1$ from centrifugal force F about the geometric axis 12, resulting in a static imbalance. There is also a moment torque $t_2$ along the geometric axis 12, resulting in a dynamic imbalance. The resulting motion of the drum is a combination of displacement and wobble.

It can be seen that any single imbalance load has both static and dynamic effects. But a coupled imbalance load as shown in FIG. 2 does not contribute a static imbalance. This coupled imbalance load is equivalent to a combination of the two individual single-imbalance loads in analysis, which is the moment in FIG. 3 less the moment in FIG. 4.

A single imbalance load is detectable above a certain speed at which the clothes load settles inside the drum. At the static imbalance detection speed (about 85 RPM for a horizontal axis washer), the torque $t_1$ is transferred to the motor shaft, causing speed or power fluctuation in the motor. But the estimated value is related only to the effect of the static imbalance. For instance, in FIGS. 1, 3 and 4, the three single imbalance loads yield an identical value regardless of whether the load is located at the front as in FIG. 3 or the back as in FIG. 4. This static imbalance is correlated to the magnitude of the imbalance (MOB). However, dynamically, there is a significant difference when an imbalance load is in the front or at the back. The front imbalance load in FIG. 3 has a much larger moment torque $t_2$ compared with that of the back imbalance load in FIG. 4, because the motor drive point is at the back.

The dynamic imbalance effect in a horizontal axis washing machine can be seen in FIG. 5, where the magnitude of the imbalance load (MOB) and the dynamic moment (or location of the imbalance back to front) are defined as two axes in a Cartesian coordinate plane. In this plane, the whole area is separated into two parts by a dynamic moment limit curve BE defined by the tolerances of the particular washing machine. Based on the dynamic mechanics theory, curve BE is the moment that is related to the effects of dynamic imbalance load at a given RPM. There are a set of such curves corresponding to different high spinning speeds. The area above this limit curve is the unacceptable imbalance area at a given spinning speed. The area below is the accepted operating area. Note, as explained above, that there is a significant difference in the effect of the moment on the curve BE between the front and the back. The imbalance at the front has larger dynamic effects that result in larger vibration.

Imagine detecting only the MOB, i.e., the static imbalance. Dynamic effect is not taken into account. To avoid severe vibration at the front, a low MOB (at line AB) has to be established in the washing machine by assuming the worst case. Consequently, all area between the curve BE and above the line AB represents an overestimated difference between the actual speed permitted by the motor controller (limited by line AB) and the maximum speed at which the machine could operate (limited by the curve BE). A consequent result is extra energy consumption during the drying cycle. If the MOB rate were established higher, as at the line CD, the area between the curve BE and below the line CD represents an underestimate for a front imbalance, and the area between the curve BE and above the line CD represents an overestimate for a back imbalance. A consequent result is unacceptable vibration and noise at high speed due to the underestimate. Thus, there is an additional need to detect the location of an imbalance load in a horizontal axis washing machine, as well as the existence of any dynamic imbalance.

Unfortunately, dynamic imbalance (DOB) is often detectable only at higher speeds. Both vertical and horizontal axis machines exhibit static imbalances, but dynamic imbalances are a greater problem in horizontal-axis machines. Imbalance-caused vibrations result in greater power consumption by the drive motor, excessive noise, and decreased performance.

Many solutions have been advanced for detecting and correcting both static and dynamic imbalances. Correction is generally limited to aborting the spin, reducing the spin speed, or changing the loads in or on the drum. Detection presents the more difficult problem. It is known to detect vibration directly by employing switches, such as mercury or micro-switches, which are engaged when excessive vibrations are encountered. Activation of these switches is relayed to a controller for altering the operational state of the machine. It is also known to use electrical signals from load cells on the bearing mounts of the drum, which are sent to the controller. Other known methods sample speed variations during the spin cycle and relate it to power consumption. For example, it is known to have a controller send a PWM (Pulse Width Modulated) signal to the motor controller for the drum, and measure a feedback signal for RPM achieved at each revolution of the drum. Fluctuations in the PWM signal correspond to drum imbalance, at any given RPM. Yet other methods measure power or torque fluctuations by sensing current changes in the drive motor. Solutions for detecting static imbalances by measuring torque fluctuations in the motor abound. But there is no correlation between static imbalance conditions and dynamic imbalance conditions; applying a static imbalance algorithm to torque fluctuations will not accurately detect a dynamic imbalance. For example, an imbalance condition caused by a front off balance load (see FIG. 3) will be underestimated by existing systems for measuring static imbalances. Conversely, an imbalance condition caused by a back off balance load (see FIG. 4) will be overestimated by existing systems for measuring static imbalances.

Moreover, speed, torque and current in the motor can all fluctuate for reasons unrelated to drum imbalance. For example, friction changes over time and from system to system. Friction in a washing machine has two sources. One may be called "system friction." Because of differences in the bearings, suspension stiffness, machine age, normal wear, motor temperature, belt tension, and the like, the variation of system friction can be significantly large between one washing machine and another. A second source of friction in a given washing machine is related to load size and any imbalance condition. Commonly owned U.S. Pat. No. 6,640,372 presents a solution to factoring out conditions unrelated to drum imbalance by establishing a stepped speed profile where average motor current is measured at each step and an algorithm is applied to predetermined thresholds for ascertaining an unbalanced state of the drum. Corrective action by the controller will reduce spin speed to minimize vibration. The particular algorithm in the '372 patent may be accurate for ascertaining static imbalances. However, is not entirely accurate for horizontal axis washing machines because it does not accurately ascertain the various dynamic imbalance conditions and does not ascertain information related to load size.

There is yet another unacceptable condition of a rotating washer drum that involves neither a static or dynamic imbalance, but establishes a point distribution that can deform the drum. A point distribution condition is illustrated in FIGS. 6(*a*) and (*b*). Imagine two identical loads 60 distributed evenly about the geometric axis 12, and on a line 52 normal to the geometric axis. There is no moment torque, either about the geometric axis 12, or along the geometric axis. Thus, there is no imbalance detectable at any speed. However, centrifugal force F acting on the loads 60 will tend to deform the drum. If the drum were a basket rotating inside a fixed tub as is common in many horizontal axis washers, the basket may deform sufficiently to touch the tub, increasing friction, degrading performance, and causing unnecessary wear and noise.

Another problem in reliably detecting imbalances in production washers regardless of axis is presented by the fact that motors, controllers, and signal noise vary considerably from unit to unit. Thus, for example, a change in motor torque in one unit may be an accurate correlation to a given imbalance condition in that unit, but the same change in torque in another unit may not be an accurate correlation for the same imbalance condition. In fact, the problems of variance among units and signal noise are common to any appliance where power measurements are based on signals that are taken from electronic components and processed for further use.

There exists a need in the art for an imbalance detection system for a washing machine, particularly horizontal axis washing machines, which can effectively, efficiently, reliably and accurately sense load size, the existence and magnitude of any imbalance condition, and sense other obstructions that may adversely affect performance. Further, there is a need for accurately determining stable and robust power information that can accommodate variations in motors, controllers, system friction, and signal noise from unit to unit.

SUMMARY OF THE INVENTION

These problems and others are solved by the present invention of a method of determining the size of a load based on its inertia in a given washing machine having a rotatable drum driven by a variable speed motor. The method comprises the steps of establishing a speed profile for the washing machine comprising a period of constant speed, an acceleration period, and a deceleration period; operating the motor to rotate the drum sequentially at the period of constant speed, acceleration period, and deceleration period, measuring the power output of the motor during each period, calculating an average power output by averaging the power output at the period of constant speed, calculating a power fluctuation integral by summing the integral area above the average power output for the acceleration period with the integral area below the average power output for the deceleration period, calculating a value that estimates the total load size by applying the power fluctuation integral to a predetermined algorithm, and storing the total load size value in a memory location.

Utilizing the inventive method, total load size for any given load can be automatically determined without regard for friction in the washing machine. The value is available for later use in detecting imbalances.

Preferably, the algorithm is obtained empirically by modeling a washing machine having parameters similar to parameters in the given washing machine. Data is obtained for the power fluctuation integral from known load sizes.

In another aspect of the invention, the magnitude of any load imbalance in the given washing machine can be determined by applying the power fluctuation integral and the total load size value to a different predetermined algorithm. The resulting value is preferably stored in a memory location. The value represents the magnitude of a load imbalance and indicates whether or not a static imbalance exists in the given washing machine. The stored value is available for later use in detecting dynamic imbalances.

Preferably, the algorithm is obtained empirically by modeling a washing machine having parameters similar to parameters in the given washing machine. Data is obtained for the power fluctuation integral from known load sizes at known locations along the horizontal axis. The method is preferably used in a horizontal axis washing machine.

In a further aspect of the invention, the existence and magnitude of a dynamic load imbalance in a given washing machine can be found by retrieving the magnitude of any load imbalance; operating the motor to rotate the drum at the lowest resonant speed for the given washing machine for a predetermined time period; measuring the power output of the motor during the time period; calculating the power integral of the power output less the average power; calculating a moment value by applying the power integral and the total load size value to a first predetermined algorithm if the magnitude of a load imbalance equals or exceeds a predetermined threshold; and calculating a moment value by applying the power integral and the total load size value to a second predetermined algorithm if the magnitude of a load imbalance is less than the predetermined threshold.

In this manner, corrective action can be taken in a subsequent cycle of the given washing machine to minimize vibration of the washing machine depending upon the moment value.

Preferably the first and second algorithms are obtained empirically by modeling a washing machine having parameters similar to parameters in the given washing machine. Data is obtained for the power integral from known load sizes at known locations along the horizontal axis.

In another aspect of the invention, load imbalances are detected and handled by determining the power fluctuation integral, the magnitude of any load imbalance, and any moment value as above; comparing the power fluctuation integral to a first maximum value; sending a signal to the user indicating the need for manual rearrangement of the load if the power fluctuation integral equals or exceeds the first maximum value; comparing the magnitude of any load imbalance to a second maximum if the power fluctuation integral is less than the first maximum value; sending a signal to the user indicating the need for manual rearrangement of the load if the magnitude of any load imbalance equals or exceeds the second maximum value; comparing the moment value to a third maximum if the magnitude of any load imbalance is less than the second maximum value; sending a signal to the user indicating the need for manual rearrangement of the load if the magnitude of moment value equals or exceeds the third maximum value; and sending a signal to the motor to go to an optimum spinning speed if the magnitude of moment value is less than the third maximum value.

The foregoing methods can be used in a washing machine having a rotatable drum, a variable speed motor for driving the drum, and a programmable controller for controlling the motor. Here, the controller is programmed to operate the motor according to any of the foregoing methods.

DETAILED DESCRIPTION

System

Figure 7:
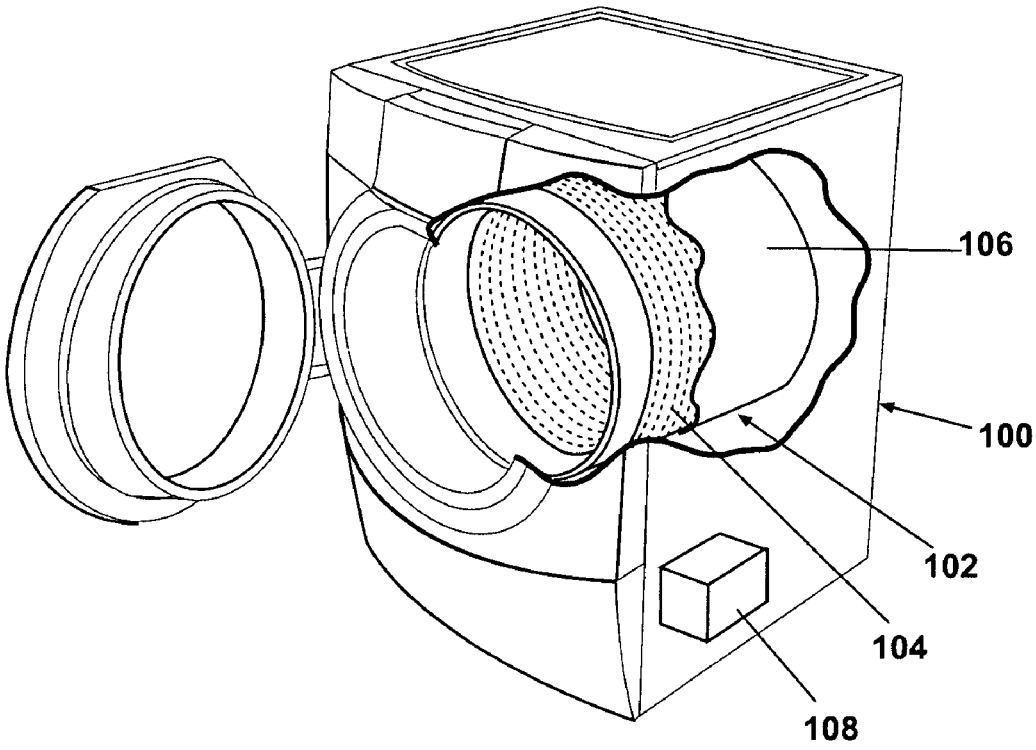
FIG. 7 is a perspective view of a horizontal axis washing machine where the invention can be applied.

FIG. 7 shows a front load, horizontal axis washing machine 100 of the type most suited for the present invention. Except for incorporating the methods and apparatus according to the invention in the washing machine 100, the physical structure is conventional. Internally, the washing machine 100 has a drum 102 comprising a rotating perforated basket 104, nested within an imperforate tub 106 that holds wash liquid during the various cycles of a washing process. It will be understood that the term "drum" refers to the rotatable structure that holds the clothing and wash liquid, whether that structure is the basket 104 alone or both the basket 104 and tub 106, or any other equivalent structure. A variable speed motor 108 typically drives the drum 102 through either a direct drive system or with pulleys via a belt. The tub 106 is typically supported by a suspension system (not shown) that can include springs, dampers, and the like.

The present invention as illustrated in FIGS. 8-24 provides a system for reliably and effectively detecting total load size (TL), the magnitude of any load imbalance (MOB), and the existence of any dynamic imbalance (DOB), using only motor control power information, and early enough in a washing cycle to effectively avoid unacceptable vibration conditions and optimize rotational speed for any given load.

Figure 8:
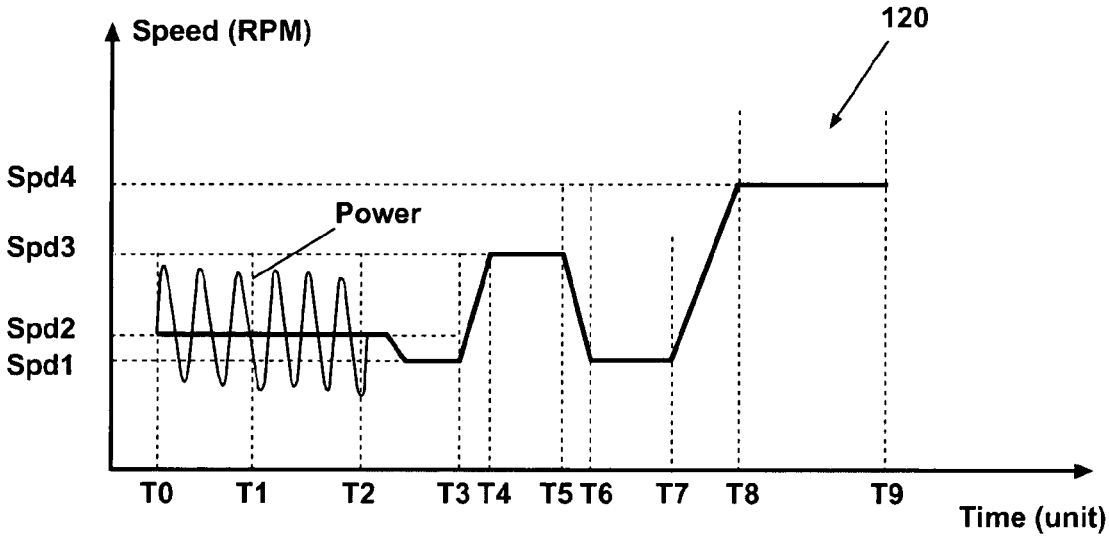
FIG. 8 is a graph showing a speed profile according to the invention.

A predetermined speed profile 120 is established as shown in FIG. 8, where the controller is programmed to operate the motor at predetermined speeds Spd1-Spd4 for time periods from T0 to T9 with ramp-ups and ramp-downs. All time periods are no more than a few seconds. Power measurements from the motor controller are utilized to ascertain values for TL, MOB, and DOB. Appropriate corrective action can be directed by the controller dependant upon the derived values. Generally, the time period from T0 to T6 is used to estimate TL and MOB. The time period T7 to T9 is for DOB detection.

1) Power average value: The time period T0-T1 is provided to measure and calculate the power average value for the use in later calculations. $P_{av}$ is preferably ascertained at Spd2, which in the illustrated embodiment is 100 Rpm.

2) Power fluctuation integral: The time period T1 to T2 is provided to measure and calculate the power fluctuation integral based on the previously determined power average value. The power fluctuation integral is correlated to MOB.

3) Total load estimate: The time period T3 to T6 is provided to estimate the total load (TL) by measuring and calculating the total inertia during ramp-up and ramp-down at identical rates. It is preferably done between Spd1 and Spd3, where Spd1 is 85 RPM in the illustrated embodiment. The Spd3 is 150 Rpm in this case. The speed difference between Spd1 and Spd3 is the speed window for TL estimate.

4) Dynamic load detection: The time period T7 to T9 is provided to detect the DOB effect. The drum is driven up to a speed close to, but below a first resonance speed Spd4. In this embodiment, Spd4 is 160 RPM. The lowest resonance speed for the illustrated embodiment is known to be 175 RPM. In the time period T7 to T8, the drum ramps up from Spd1 to Spd4.

Power Measurement

In this invention, an algorithm has been developed for monitoring real-time power. The power input information is calculated from the DC bus voltage and DC bus current of the motor control inverter. A micro-controller or digital signal processor (DSP) handles this signal processing. A variable speed motor control system drives the drum to track the reference speed profile in a closed loop status. A filtering technique is provided to reduce any noise impacts in signal processing.

Figure 9:
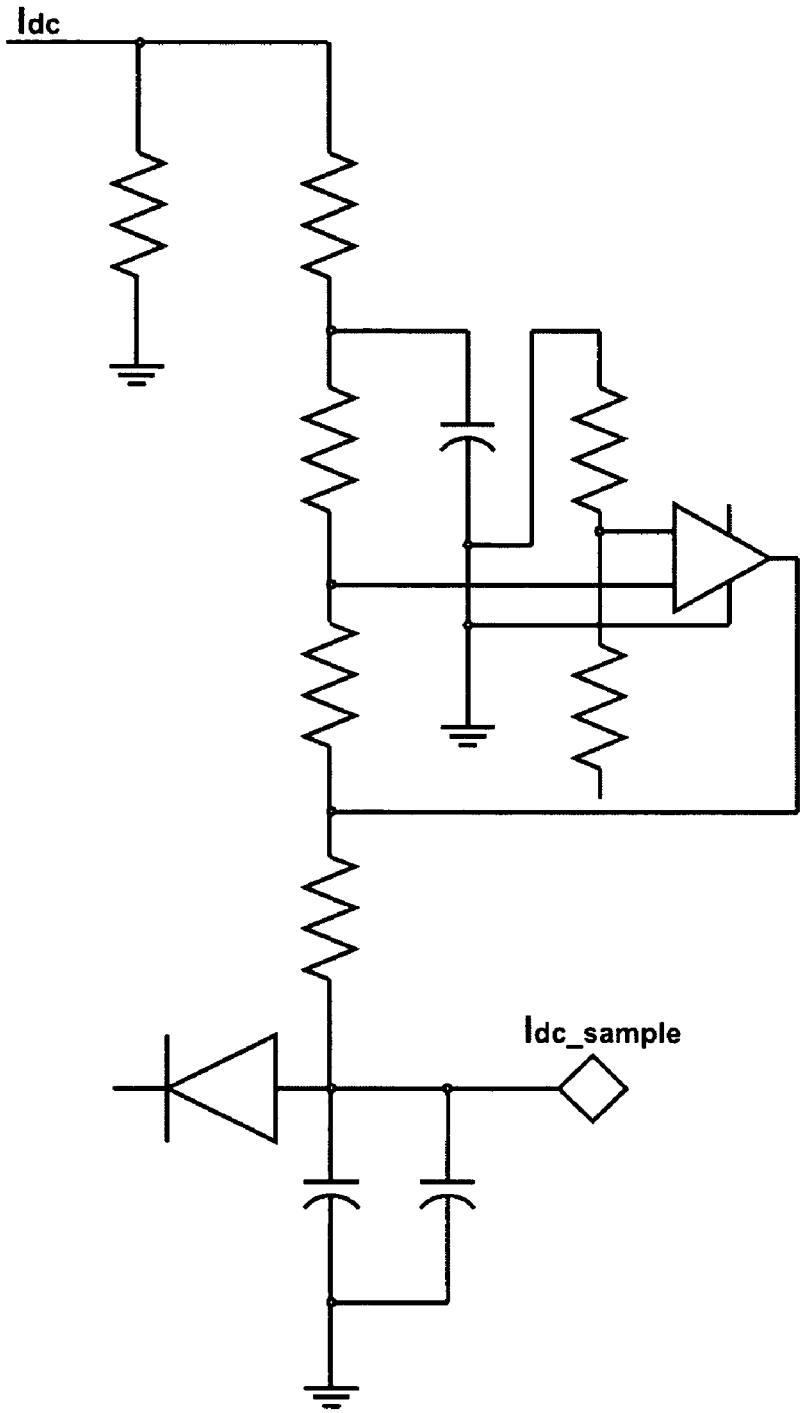
FIG. 9 schematically shows a circuit for measuring DC bus voltage of a motor control inverter according to the invention.
Figure 10:
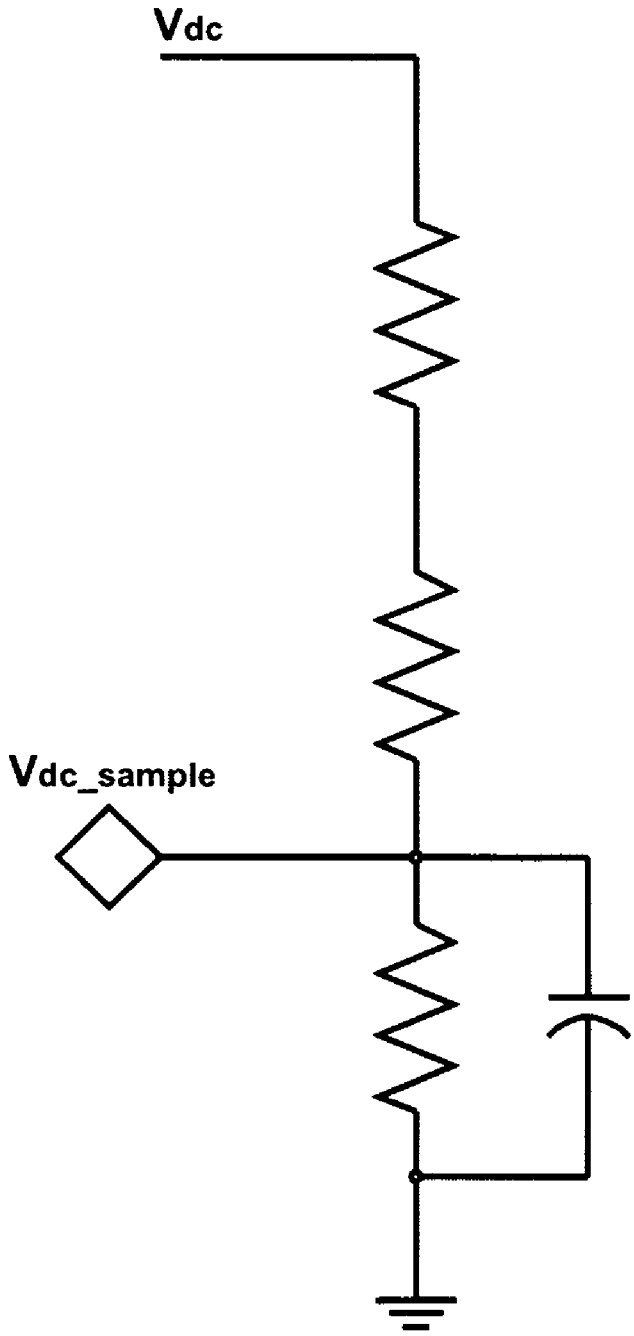
FIG. 10 schematically shows a circuit for measuring DC bus current of a motor control inverter according to the invention.

Power P for detecting TL, MOB and DOB in the system of the invention is derived from the DC bus voltage ($V_{dc}$) and DC bus current ($I_{dc}$). The DSP preferably samples $V_{dc}$ and $I_{dc}$ simultaneously at a sampling rate of once every 50 microseconds or 20,000 times per second (20 KHz). In general, the sampling rate can be in a range of 20 to 50 KHz. FIGS. 9 and 10 show exemplary DC bus voltage and DC bus current sensing circuits. It will be apparent that the components of the sensing circuits, such as resistors, may vary from one controller to another, resulting in an offset when measuring $I_{dc}$ from a given controller. Consequently, the power calculation of P may not be accurate from one controller to another. In practice, current offsets in measurements are unavoidable. As a result, some self-calibration for current offset is necessary for an accurate power calculation.

Initial offset calibration occurs by automatically detecting both $V_{dc}$ and $I_{dc}$ as soon as the controller is powered on, determining the offset, and then making an adjustment to remove the offset. Detection at the normal sampling rate of 20-50 KHz occurs during initialization of the motor controller where the induction motor is not driven (PWM is shut down), and DC bus voltage is set up. At the time of initialization, measured current represents the current offset. The current offset is thus measured at each sample and averaged over a variable number of times, preferably 216-512 (generally enough for accuracy). Preferably, a default value is n=512. Averaging occurs as follows:

$$i_{off-set} = \frac{i^1 + i^2 + \ldots + i^n}{n}$$

Figure 11:
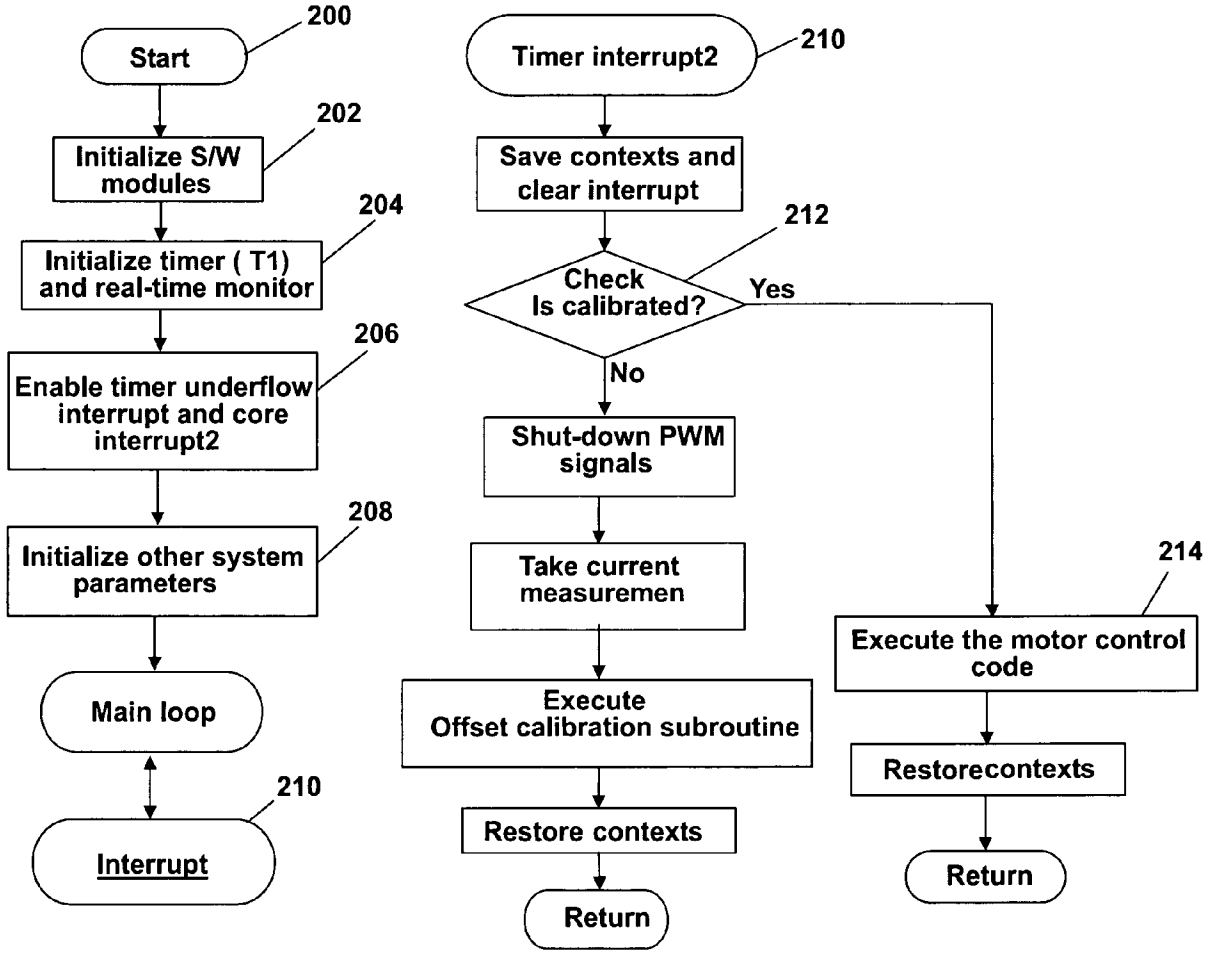
FIG. 11 is a flow chart illustrating an offset calibration method according to the invention.

After averaging the measured current (offset current) n times, a calibration value is calculated that, if applied to a sampled current when the motor is running, will result in a zero offset. Thereafter, in the calculations of power P based on sampled current and voltage, the calibration value is used to compensate for offsets. Referring now to FIG. 11, the flow of steps in the calibration can be seen. Upon startup 200 of the motor controller, regardless of architecture, normal initialization occurs, e.g. initializing S/W modules, timers and other system parameters (202, 204, 206, 208). When the system reaches a predetermined interrupt 210, contexts are saved and interrupt flags are cleared. Then at 212 the system queries whether or not calibration has occurred. If not, then a loop commences where PWM signals are shutdown so that the motor does not start, and current sampling commences at the predetermined sampling rate (20-50 KHz). Offset values are calculated in accord with the running average $i_{off-set}$ until the number of samples reaches n (preferably 216-512), at which time the calibration is complete and the flag for the query at 212 is set to true. At that point, the motor control scheme 214 will be started. It is during the motor control scheme that measurements of power P (adjusted for the offsets) occur.

Noise is always a component of sampling signals received from the DC bus voltage and current circuits. Accuracy of power calculations can be enhanced by filtering data points affected by noise spikes. Such signals will have a sharp transition among sampling values. An adaptive moving window average filter according to the invention filters out such bad data points and is described herein.

Suppose that at any instant k, the power average of the last n (for example, 256 points) samples of a data sequence is given by:

$$\overline{p_k} = \frac{1}{n}\sum_{i=k-n+1}^{k} p_i.$$

Similarly, at the previous time instant, k−1, the power average of the last n samples is:

$$\overline{p_{k-1}} = \frac{1}{n}\sum_{i=k-n}^{k-1} p_i$$

Therefore, $$\overline{p_k} - \overline{p_{k-1}} = \frac{1}{n}\left(\sum_{i=k-n+1}^{k} p_i - \sum_{i=k-n}^{k-1} p_i\right) = \frac{1}{n}(p_k - p_{k-n}),$$

which can be expressed as:

$$\overline{p_k} = \overline{p_{k-1}} + \frac{1}{n}(p_k - p_{k-n})$$

Thus, at any instant, a moving window of n values is used to calculate the power average of the data sequence. Three values can thus be continuously calculated for the moving window: $\overline{p_k}$, $\overline{p_{k-1}}$, and $\overline{p_{k+1}}$, Furthermore, errors among the three power average values can be calculated compared continuously, as follows:

$$e_{k+1} = \overline{p_{k+1}} - \overline{p_k}$$

$$e_k = \overline{p_k} - \overline{p_{k-1}}$$

$$e_{k-1} = \overline{p_{k+1}} - \overline{p_{k-1}}$$

A running comparison of errors will identify which errors are large enough to be over a pre-set limit. In such case the associated sample that resulted in the large error should be treated as a bad point and will be discarded in the sense that the sample is not used and is no longer available for further processing. Thus, higher accuracy and stability are achieved. In the illustrated embodiments, discarding a bad sample means that neither the given current and voltage samples, nor the resultant power calculation is used in the imbalance detection routines described hereinafter, nor is it used in the calibration, nor is it used further in establishing the moving window of the filtering process.

To ensure the output power information is stable, the motor control has to work at a steady status at a certain speed range. In this speed range, all parameters of controllers and regulators operate at their non-saturated regions meanwhile driving the drum to follow tightly the special speed profile.

Determining TL and MOB

For a horizontal axis washer, there is a correlation between the total load size (TL) of the contents in the drum and its inertia. Thus, inertia is an appropriate variable to measure for determining load size. When drum speed is suddenly changed, the system inertia impacts dynamic momentum. The motor has to deliver higher torque to force the drum to follow the command speed profile 120. Therefore, the motor torque information is correlated to the system inertia. In a variable speed motor system, the power requirements will transfer the torque change to its power P calculated from $V_{dc}$ and $I_{dc}$. Hence, power information is used as the variable to process.

On the other hand, when present, an unbalanced load generates either speed or power fluctuations. Such fluctuation is a dominated link to MOB. Thus, processing the fluctuation signal can be utilized to detect the MOB. However, this fluctuation is also interacted by the TL as a natural characteristic. Consequently, TL information must be used to complete an accurate determination of MOB.

Power Average Value

As mentioned earlier, the time T0 to T1 is the period to calculate average power value $P_{av}$, preferably at a slightly elevated speed Spd2. The average power $P_{av}$ will be used as a base power value for the further sensing algorithms. The average power is calculated as:

$$Pav = \sum_{k=1}^{N} Pk/N \tag{1}$$

where,

Pk is real-time power reading value in each sampling; and

N is the total sampling times in the period.

Power Fluctuation Integral

Figure 12:
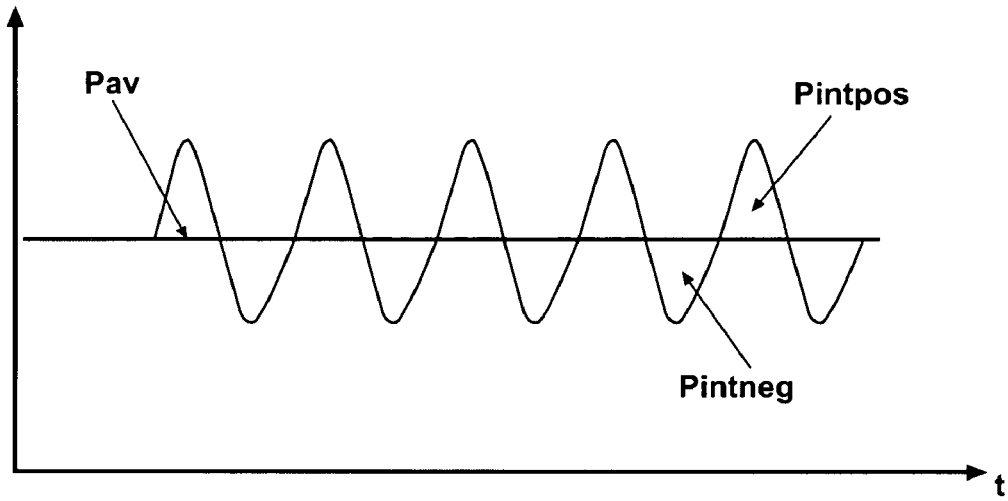
FIG. 12 is a graph showing schematically the calculation of the power fluctuation integral Pintegral.

Also as mentioned earlier, the time from T1 to T2 is the period to calculate the integral value of power fluctuations. It is preferably taken at Spd2. FIG. 12 is a diagram illustrating schematically the calculation of the integral area where, Pintpos is the power integral area above the average power;

Pintneg is the power integral area below the average power.

The total power fluctuation integral is the sum of the two values:

$$Pintegral = Pintpos + Pintneg \tag{2}$$

$$P\ int\ pos = \sum_{k=1}^{N} [Pk - Pav] \text{ for } Pk > Pav \tag{3}$$

$$P\ int\ neg = \sum_{k=1}^{N} [Pav - Pk] \text{ for } Pk > Pav \tag{4}$$

This value is related to the magnitude of the imbalance load (MOB). But the Pintegral value only partially shows the imbalance load impact. The final MOB value is determined when the TL information is available.

Total Load Size Estimate

Determining load size TL in a given washing machine at any given time must account for system friction and load induced friction, including variations. As mentioned earlier, it is measured in a window between Spd1 and Spd3. Thus, the time period T2 to T3 is provided for the system to stabilize at the lower Spd1 of about 85 RPM. The time from T3 to T6 is the period to estimate the load size TL. This portion of the speed profile 120 can be referred to as the "A" profile because of its appearance. It is noted that the rate of acceleration from T3 to T4 is the same as the rate of deceleration from T5 to T6. In general, the system dynamic performance can be expressed as an equation, $$Te - Tl = J\frac{d\omega}{dt} + B\omega + C(\omega) + C(\omega)F(\omega) \tag{5}$$

where,

Te is motor electromagnetic torque;

Tl is load torque;

J is inertia and is assumed to be constant in the sensing period;

ω is motor angular speed;

B is a viscous friction constant;

C(ω) is a function of friction varying with the speed due to imbalanced load effects; and F(ω) is a function of speed fluctuation, covering all variations.

When an unbalanced load exists, the system will demonstrate complex dynamic behavior because of variations in the suspension components. This dynamic behavior is too complicated to be expressed in a single well defined function.

But the following is known: when there is no water inside the drum, T1 is equal to zero. In the period of acceleration T3 to T4, equation (5) can be expressed as an integral in time on both sides:

$$\int Tepos\,dt = \int J\frac{d\omega}{dt}dt + \int B\omega\,dt + \int C(\omega)F(\omega)dt \tag{6}$$

Figure 1A:
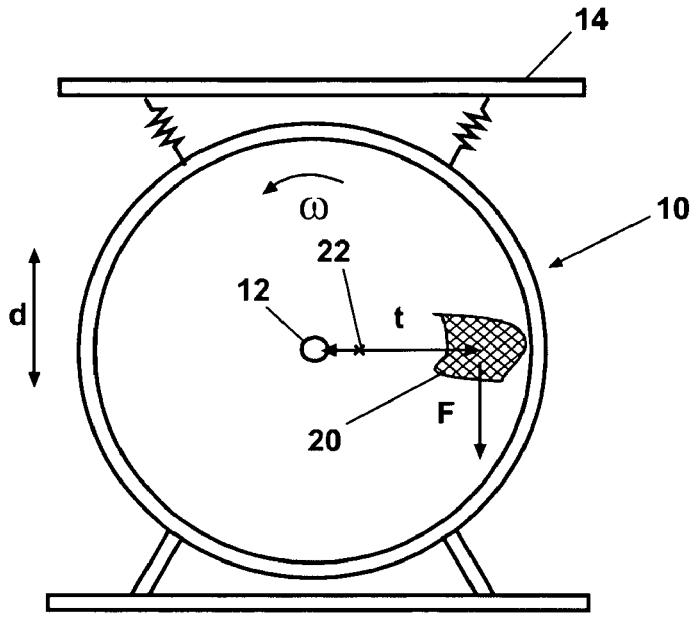
FIG. 1(*a*) and (*b*) is a schematic illustration of the concept of static imbalance.
Figure 1B:
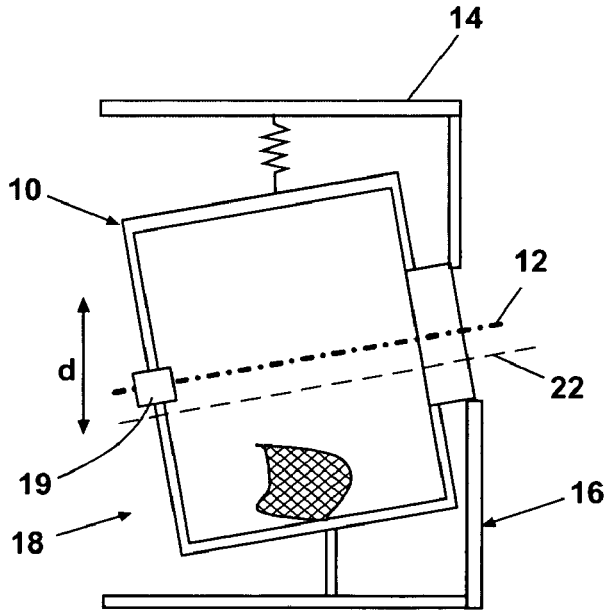
Figure 2A:
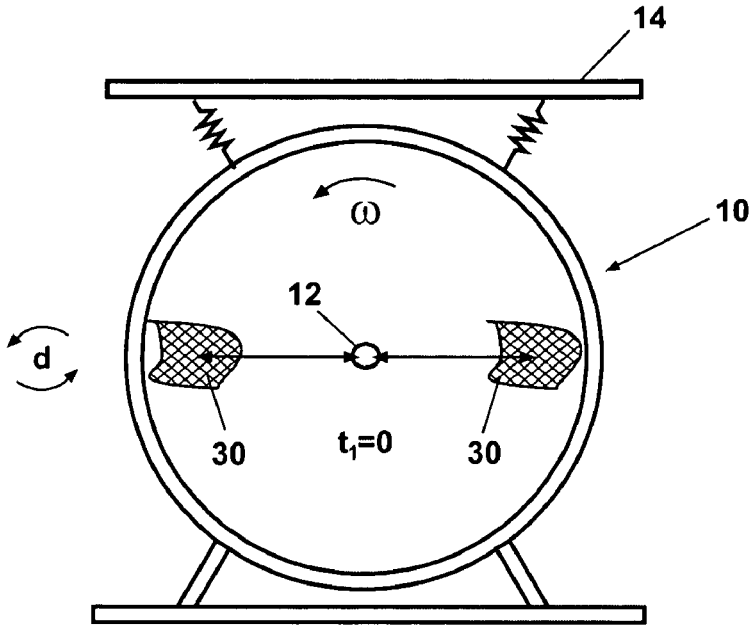
FIG. 2(*a*) and (*b*) is a schematic illustration of the concept of dynamic imbalance caused by a dynamic off balance load.
Figure 2B:
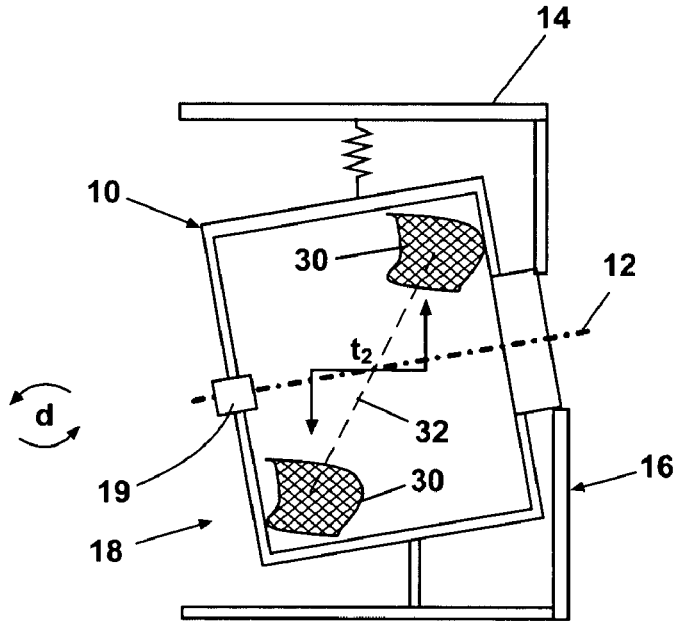
Figure 3A:
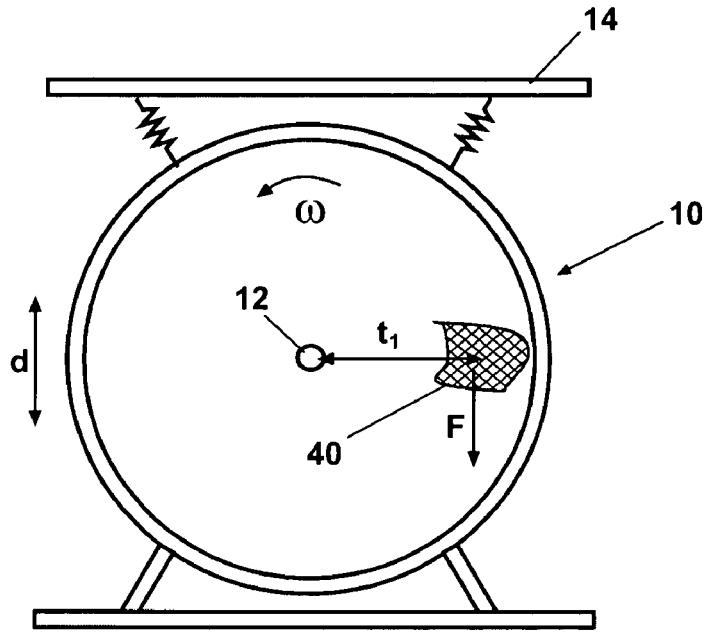
FIG. 3(*a*) and (*b*) is a schematic illustration of the concept of dynamic imbalance caused by a front off balance load.
Figure 3B:
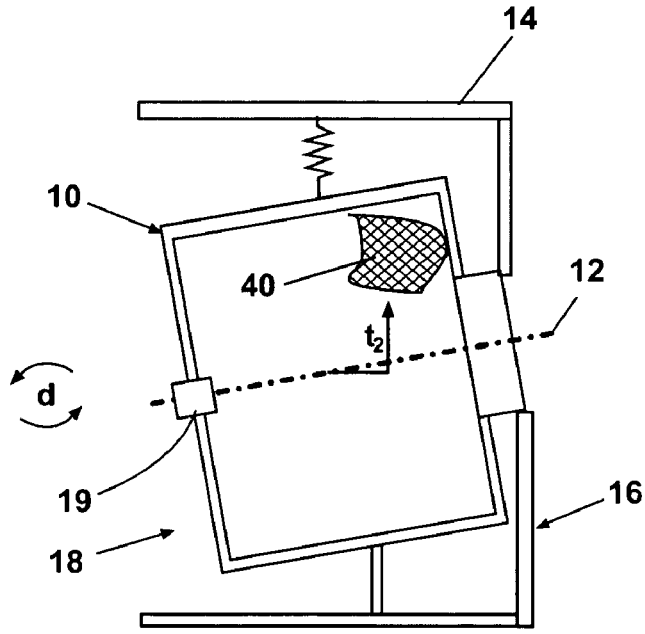
Figure 4A:
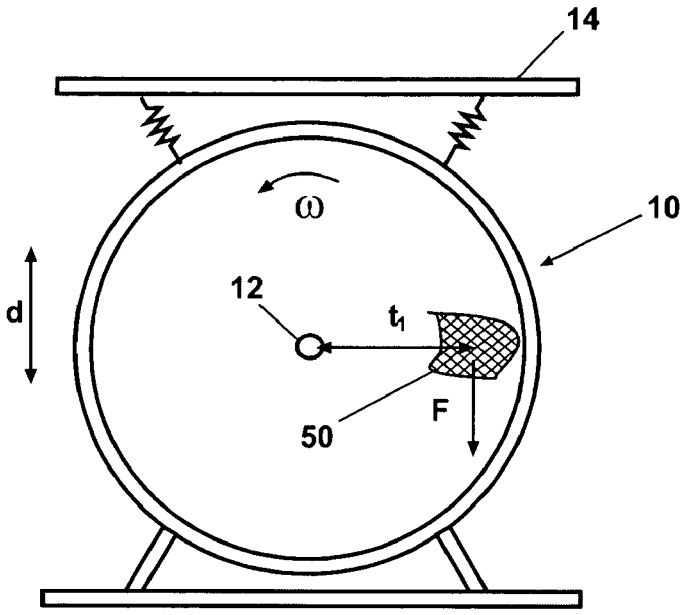
FIG. 4(*a*) and (*b*) is a schematic illustration of the concept of dynamic imbalance caused by a back off balance load.
Figure 4B:
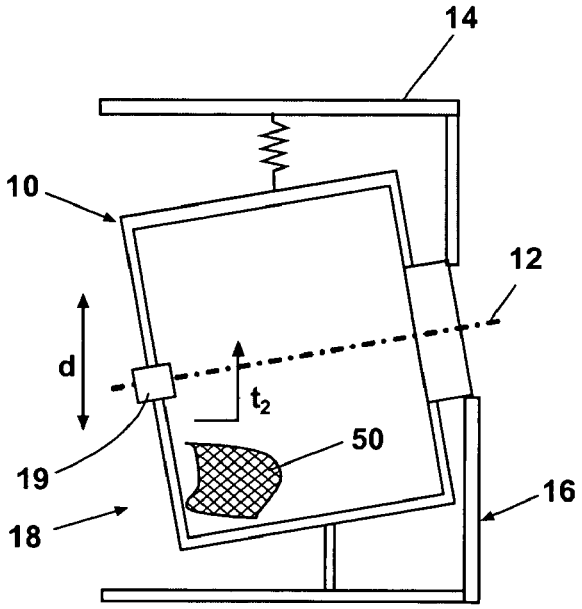
Figure 5:
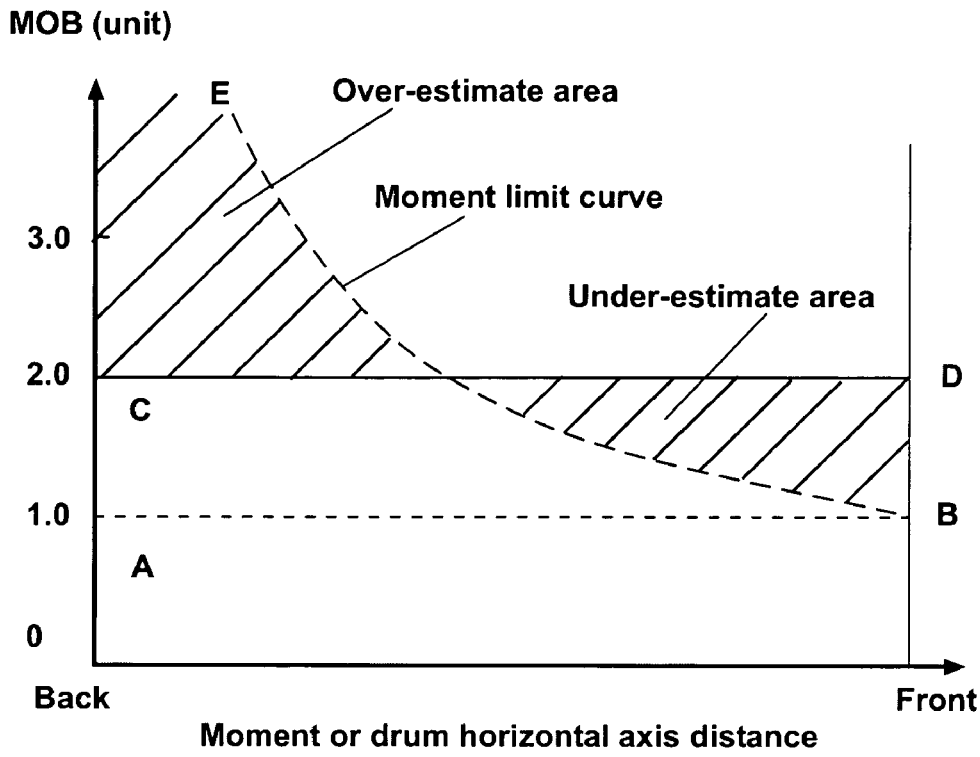
FIG. 5 is a graph showing the magnitude of an imbalance load (MOB) plotted against the dynamic moment (location) of the load.
Figure 6A:
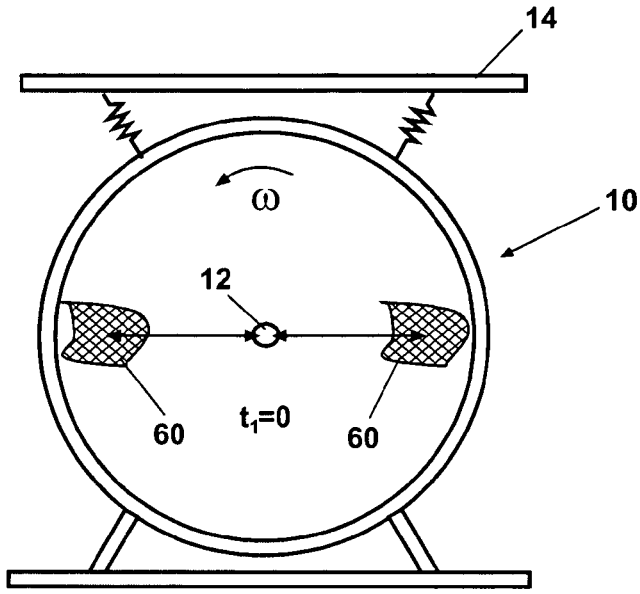
FIG. 6(*a*) and (*b*) is a schematic illustration of the concept of a point distribution condition.
Figure 6B:
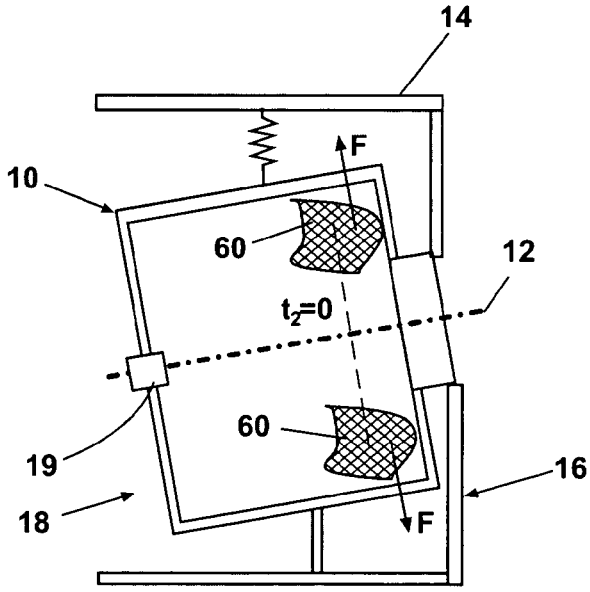

In equation (6), the left side item is the motor torque curve area as shown in FIG. 5, and is expressed as:

$$TEINTpos = \int(Tepos - Tav)dt \tag{7}$$

The first item of the right side of equation (6) can be expressed as:

$$\int J\frac{d\omega}{dt}dt = J \cdot W\ int \tag{8}$$

where,

Wint is the time integral area of angle speed, and

J is a constant inertia.

In the period of deceleration from T5 to T6, equation (5) can be expressed as an integral in time on both sides:

$$\int Teneg\,dt = \int J\frac{d\omega}{dt}dt + \int B\omega\,dt + \int C(\omega)F(\omega)dt \tag{9}$$

Note that the first item of the right side is negative due to deceleration. The left side of equation (9) can also be expressed as:

$$TEINTneg = \int(Teneg - Tav)dt \tag{10}$$

The first item on the right side of equation (10) is equal to equation (8) except that the sign changed to negative. Note that the items at the right side for both equations (6) and (9) are identical because the speed profile 120 runs the same ramp rate in acceleration and deceleration. Subtracting equation (9) from equation (6) yields:

$$J = \frac{(TEINTpos - TEINTneg)}{2 \cdot Wint} \tag{11}$$

In fact, Wint is constant because the ramp rate is fixed by the speed command. When the torque is replaced with the power, and inertia with TL, the total load size TL can be expressed as:

$$TL = K1 \cdot (PINTpos - PINTneg) + K2 \tag{12}$$

Where, $$PINTpos = \sum_{k=1} [Pk - Pav] \quad \text{ramp-up} \tag{13}$$

$$PINTneg = \sum_{k=1} [Pk - Pav] \quad \text{ramp-down} \tag{14}$$

and K1 and K2 are two constants, depending upon the parameters of a given machine. PINTpos and PINTneg are calculated power during acceleration and deceleration, respectively. Pintegral is thus PINTpos−PINTneg.

Note that equation (12) arrives at a TL value without any calculation for friction. It appears that the system inertia can be calculated by the two integrals of DC bus power without directly dealing with any system friction. Thus, the friction impact has been automatically removed according to the invention. The power integral for acceleration is positive power, in motoring status. However, the power for deceleration mostly is negative, in braking status, but may be positive (motoring status) if the system inertia is too small corresponding to the defined ramp-down rate. Thus, both torque and power can be used in this method.

It may be helpful to discuss the friction compensation in greater detail. During the ramp-up period T3 to T4, the actual motor power overcomes any inertia and any system friction in order to achieve Spd3. Typically there is a larger positive power needed than would be expected if friction forces were zero or minimal. During the ramp-down period T5 to T6, on the other hand, the motor is braking. Friction is always against the motion direction and absorbs the dynamic energy stored in the system running at high speed. Thus, in deceleration, the motor delivers only a portion of the power otherwise needed to follow the speed profile. As friction is greater, positive motor power will be larger in ramp-up, but the negative motor power will be smaller in ramp-down because the system dynamic energy provides the energy consumed by friction.

Therefore, the total sum of motor power in the whole sensing cycle depends only on system inertia, without regard to friction.

Figure 13:
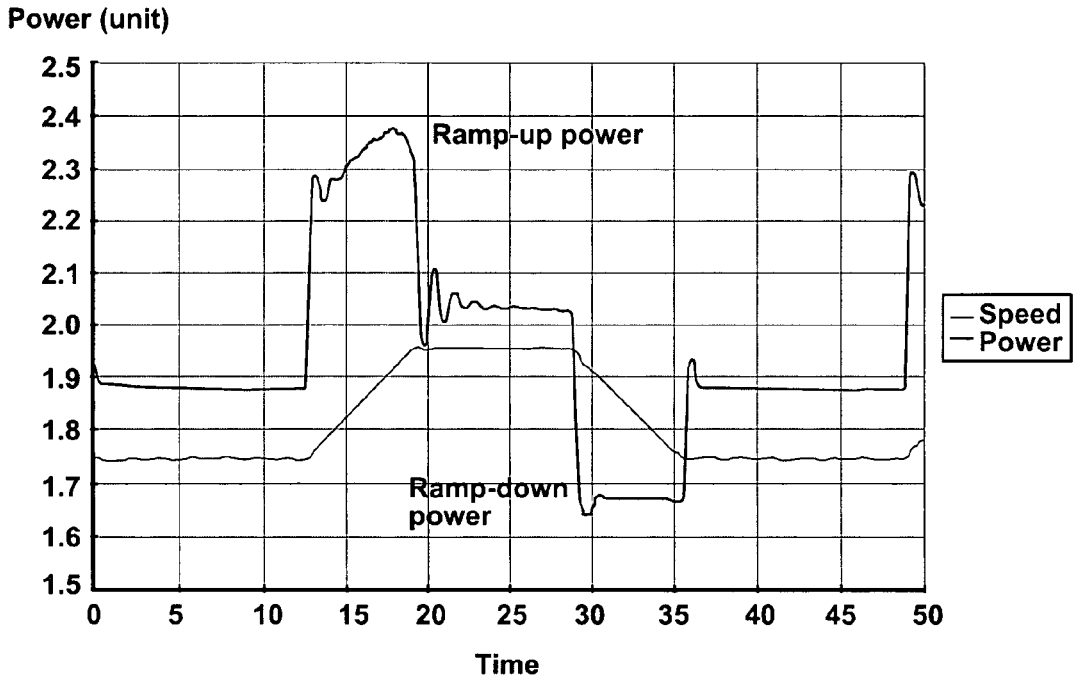
FIG. 13 is a graph showing speed and power curves over time for a 7 Kg balanced load.
Figure 14:
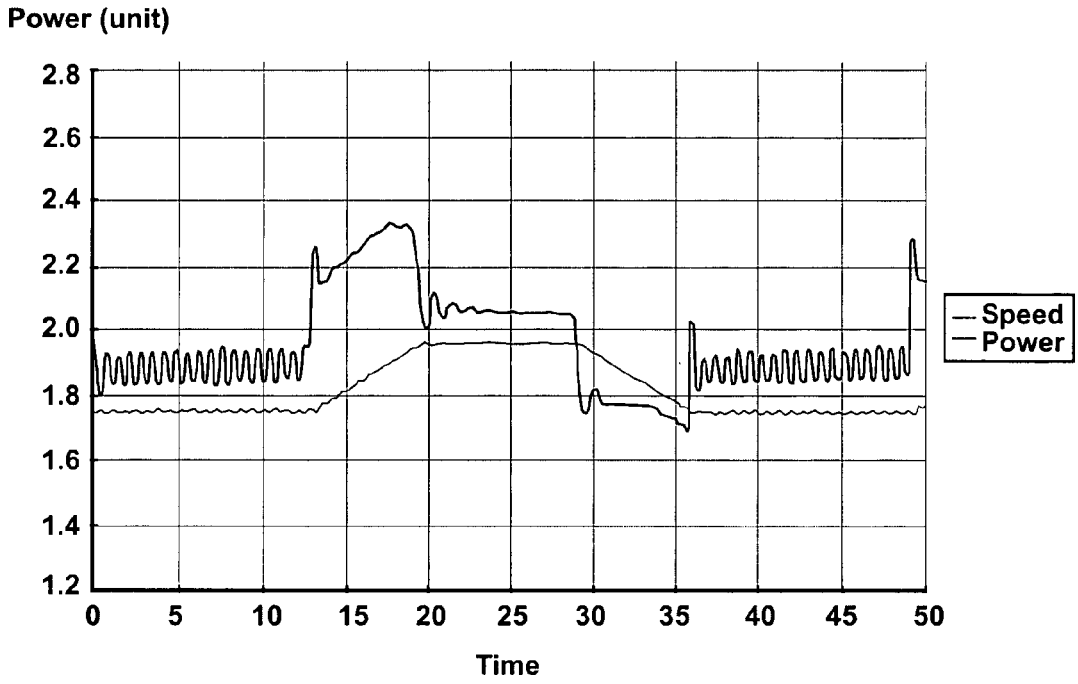
FIG. 14 is a graph showing speed and power curves over time for a 3 Kg balanced load and a 1 Kg unbalanced load.
Figure 15:
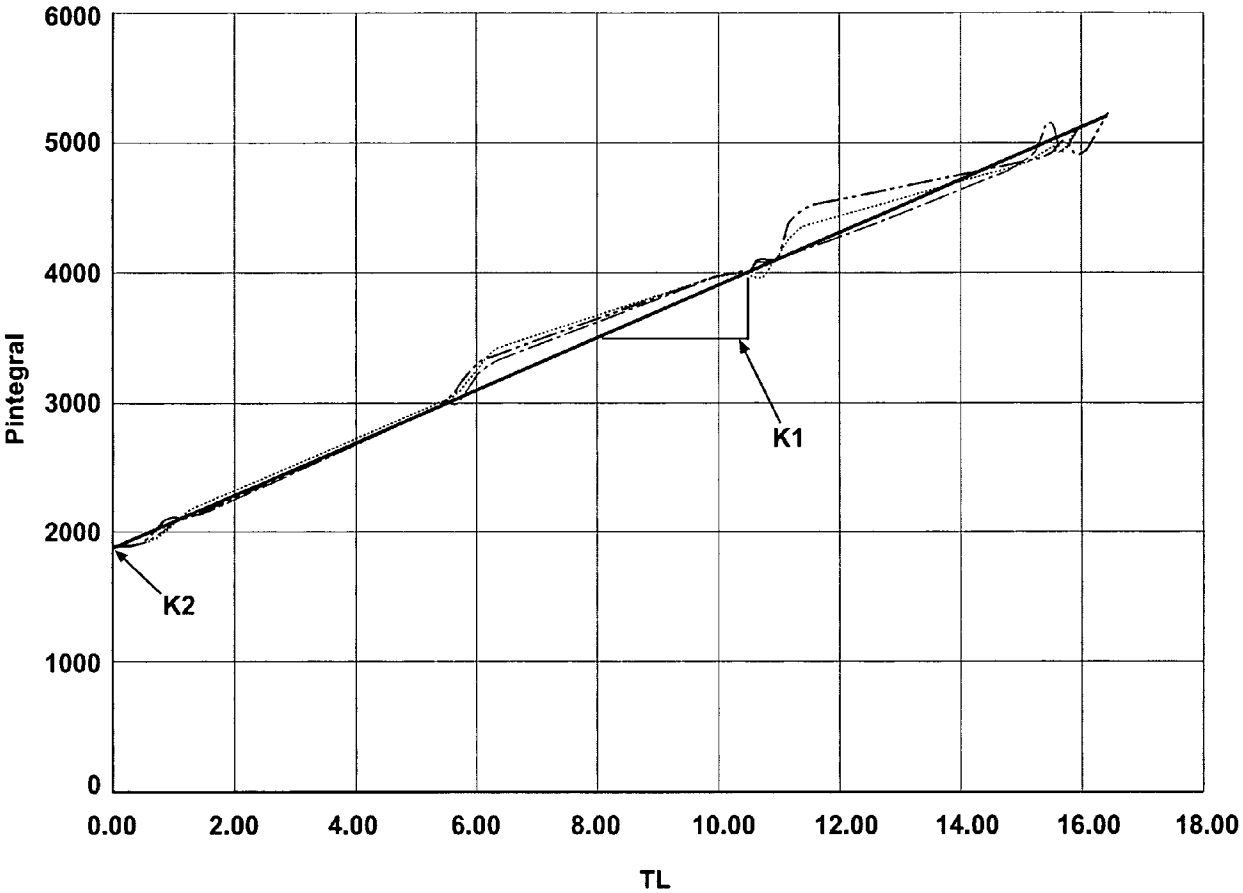
FIG. 15 is a graph showing Pintegral plotted over total load size.

These effects are borne out empirically. FIG. 13 shows speed and power curves over time for a 7 Kg balanced load in a horizontal axis washing machine. The speed profile replicates a portion of the speed profile 120 from T3 to T6. It can be seen that the power to ramp up exceeds the power to ramp down. Similarly, FIG. 14 shows the same plots for an unbalanced load of 1 Kg in a horizontal axis washing machine where the power to ramp up still exceeds the power to ramp down.

Since the calculation of TL is based on differential values, variations in the system are effectively cancelled by the inventive method resulting in a robust estimation of TL. The method performs precise estimation no matter how system friction varies and how much unbalance load exists.

Determination of the constants K1 and K2 for a given washer are obtained by modeling the washer with known total load sizes (TL). Data is gathered by using a known load at a known location in the drum and measuring Pk while in the "A" portion of the speed profile. TL is calculated as the sum of the known load and off balance load created by the moment due to its location. Plotting TL against Pintegral yields a linear curve. The slope of the curve is the constant K1 and the Y-axis intercept is the constant K2. See FIG. 15 for a sample plot from a given horizontal axis washer according to the invention where K1 is 0.4835 and K2 is 927.3.

As stated, MOB is a function of the power fluctuation integral Pintegral, as well as the total load size TL. Consequently, the MOB value can be quantified by a function defined as:

$$MOB=F(Pintegral,TL) \tag{15}$$

Figure 16:
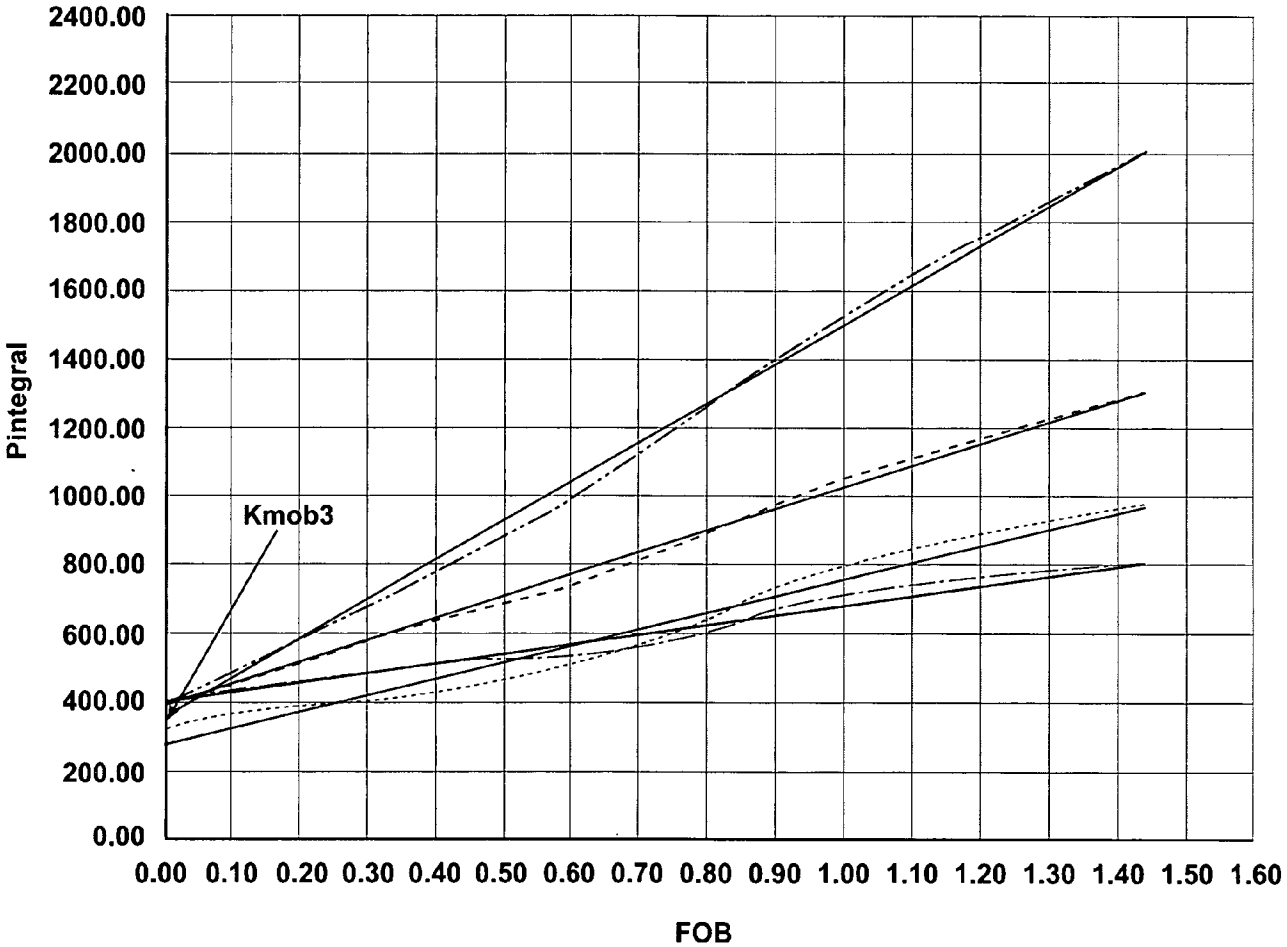
FIG. 16 is a graph showing Pintegral plotted over the dynamic moment for several different load sizes, derived from empirical modeling data.
Figure 17:
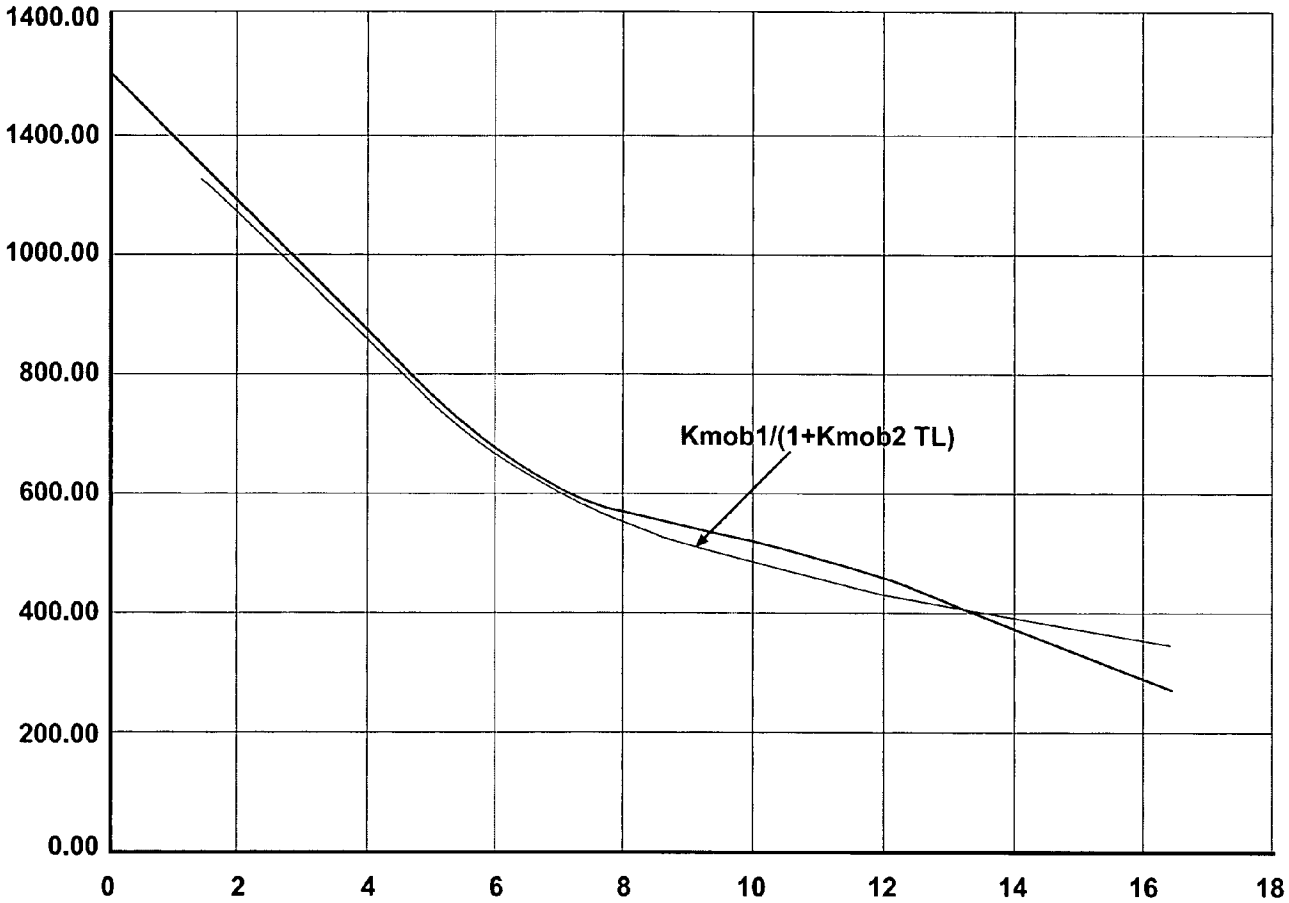
FIG. 17 is a graph showing the curve resulting from the regression function applied to the curves of FIG. 16.

Determining exactly what that function is requires more modeling for a given washer. Plotting known off balance load values for different known load sizes yields a series of linear curves. See, for example, FIG. 16, which illustrates a sample plot from the same horizontal axis washer mentioned above. Each curve has a different slope. How the slopes change is key. Using a regression function, a resulting curve is shown in FIG. 17, which can be defined as:

$$Kmob1\cdot(1+Kmob2\cdot TL)$$

where Kmob1=1/1450 and Kmob2=0.2. The average of the intercepts at the y-axis of FIG. 16 provides a constant Kmob3, which in this case is 380. Thus, for this example, $$MOB=Kmob1\cdot(1+Kmob2\cdot TL)\cdot(Pintegral-Kmob3) \tag{16}$$

Once the constants and functions are determined from the modeling for a given washer, TL and MOB can be calculated for any subsequent load by running the "A" profile, using the functions defined in equations (12) and (16).

Figure 18:
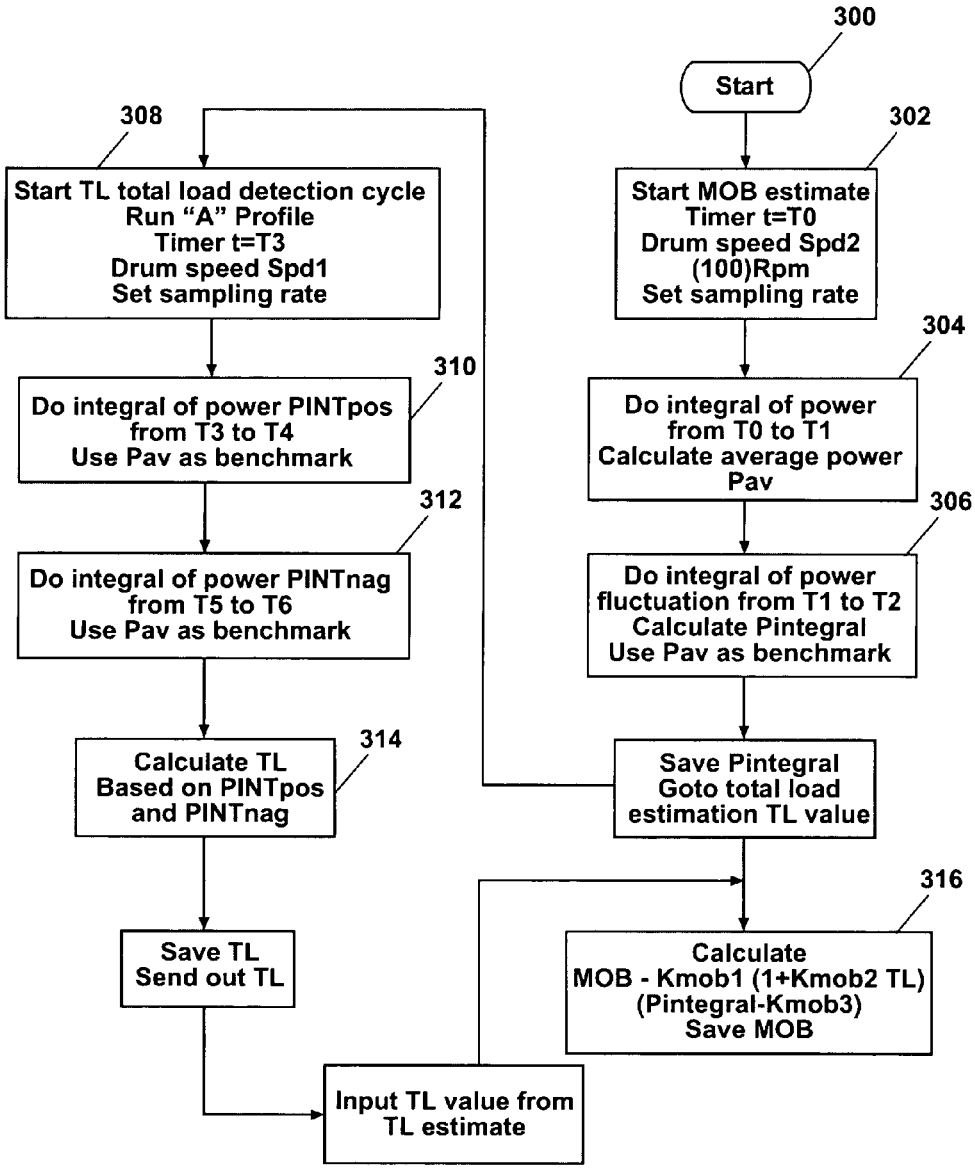
FIG. 18 is a flow chart illustrating the determination of the magnitude of a load imbalance (MOB) and the total load size (TL) according to the invention.
Figure 19:
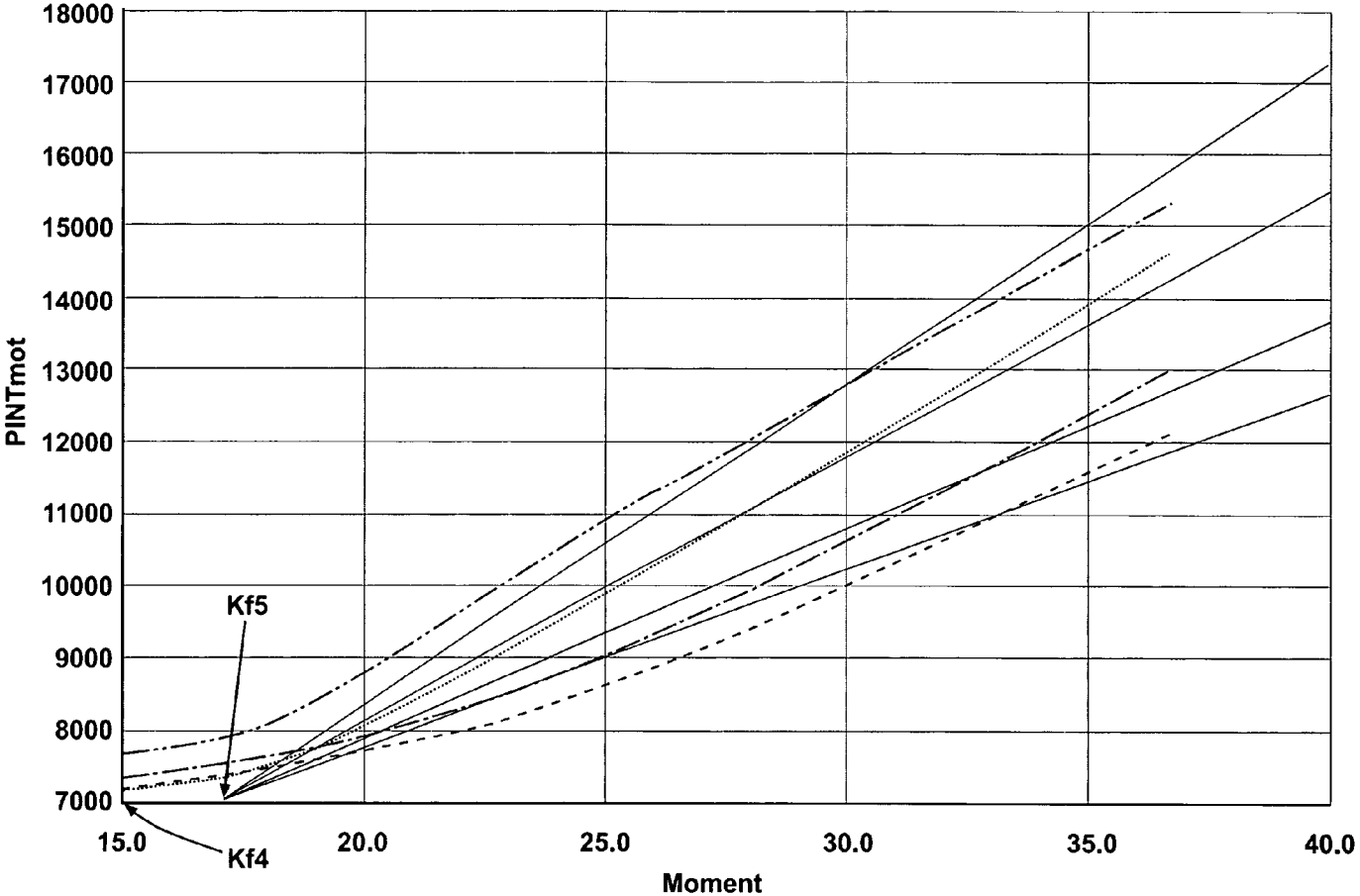
FIG. 19 is a graph showing the power integral of actual power less average power at Spd2 (PINTmot) plotted over the dynamic moment for several different load sizes with a static imbalance, derived from empirical modeling data.
Figure 20:
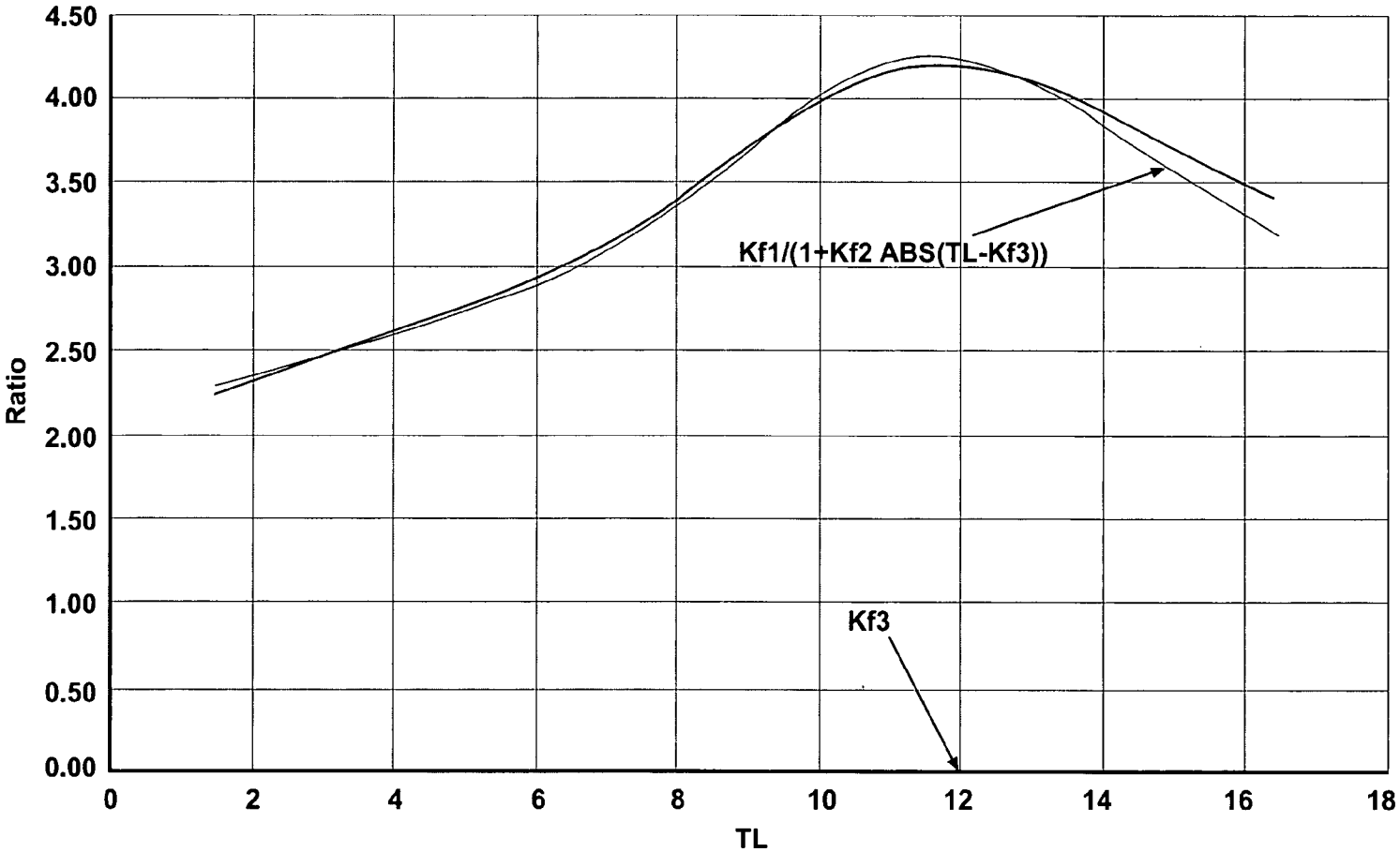
FIG. 20 is a graph showing a moment ratio plotted over total load size, derived from the empirical modeling data of FIG. 19.
Figure 21:
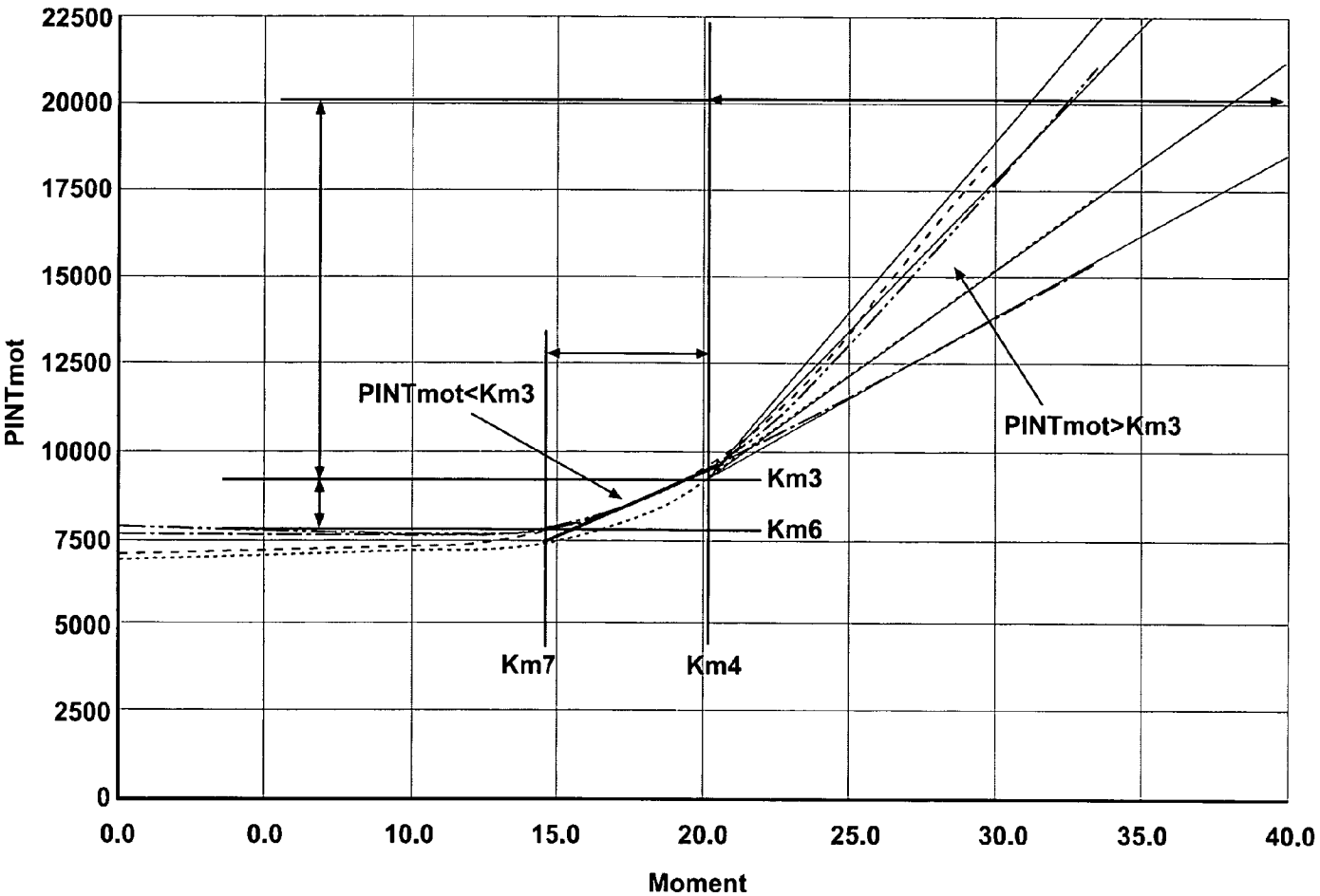
FIG. 21 is a graph showing the power integral of actual power less average power at Spd2 (PINTmot) plotted over the dynamic moment for several different load sizes with a dynamic imbalance, derived from empirical modeling data.
Figure 22:
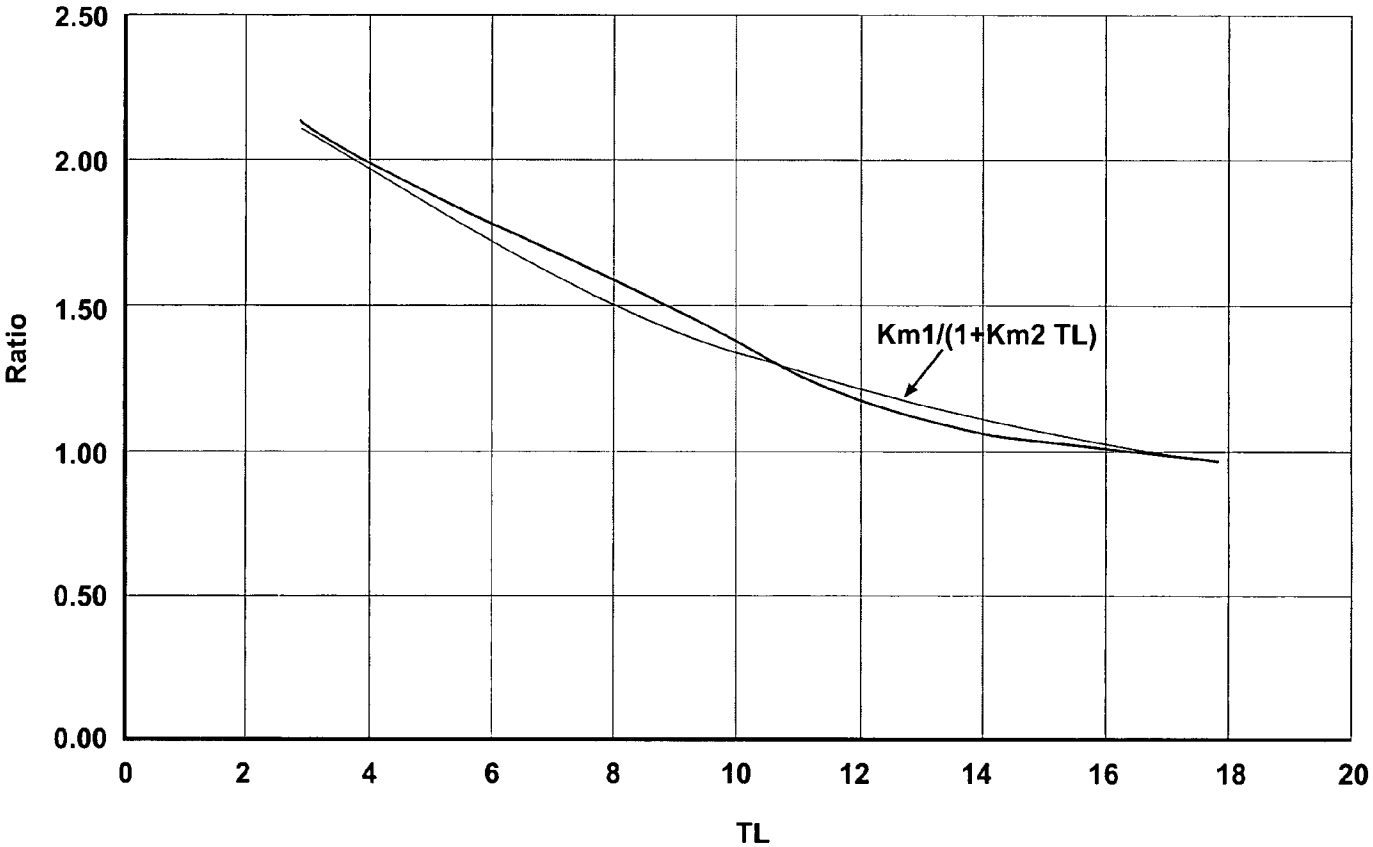
FIG. 22 is a graph showing a moment ratio plotted over total load size, derived from the empirical modeling data of FIG. 21.

FIG. 18 is a flowchart showing the logic of how a processor can determine values for MOB and TL using the foregoing algorithms according to the invention. Upon loading the washer, the user initiates a start 300 to activate the system. A timer is set to T0, and the drum speed is ramped to Spd2 at 302. The sampling rate is predetermined. Real time power measurements are taken from the motor during T0 to T1 and Pav is calculated (304). Power fluctuations are measured from T1 to T2 and Pintegral is calculated and saved (306).

Thereafter the load size detection cycle is run in the "A" profile from T3 to T6. At 308, drum speed is reduced to Spd1 and the timer is clocked to T3. Real time power is again measured at the sampling rate and PINTpos is calculated during T3-T4 (310). Similarly, PINTneg is calculated during T5-T6 (312). Thereafter, normally during T6-T7, TL is calculated and saved (314). At block 316, TL and Pintegral are inputted into the predetermined function for MOB, and MOB is calculated.

Dynamic Load Detection

In the inventive system, dynamic imbalance load (DOB) detection is predicated on the fact that there are several resonance speeds below the operating speed where vibrations due to DOB may appear. A washing machine may vibrate detectably if operating at one of these resonance speeds. This phenomenon provides an opportunity for early DOB detection because the DOB effects start to show up when the actual speed is close to a resonance speed. The system preferably utilizes a speed Spd4 that is close to, but below the lowest resonance speed for the given washing machine. With this speed, DOB effects show up and cause some measurable vibration. The vibration results in a detectable increase of system friction and energy consumption. Consequently, the motor controller has to output higher power to maintain Spd4. By processing the power information, the DOB can be quantified while operating within the speed profile 120. Which speed to use for detecting DOB varies due to the differences of washer suspension system, and depends on the actual first resonance speed of the given washing machine.

When the drum achieves a stable speed at Spd4, the power integral of actual power $P_k$ at Spd4 less the average power $P_{av}$ at Spd2 is calculated in the time period T8 to T9.

$$PINTmot=\sum_{k=1}[Kc\cdot Pk-Pav]\quad \text{During } T8 \text{ to } T9 \tag{17}$$

where, Kc is a constant, arbitrarily selected to amplify the resultant value for better processing. It will be understood that sometimes the value of Pk will be close to Pav, making PINTmot too small to be useful. In this case, Kc=2.0.

As with MOB, the calculated power integral in the time period T8 to T9 (PINTmot) is a function of DOB. But the final DOB value is also a function of MOB, if present, as well as TL. Thus, there must be a determination of the existence of MOB. For a threshold determination of the existence of MOB, we preferably use a value of 0.25 Kg. Below that value, MOB is deemed to be nonexistent. Above that value, MOB is deemed to exist. At a MOB value of 0.25 Kg or less, the washer will go to maximum spinning speed without the deleterious effects of a coupled DOB. If MOB is absent, dynamic detection for the moment MOT is caused by single imbalance load (SOB). If MOB exists, the detection for MOT is caused by a coupled imbalance load (COB).

If, MOB exceeds the threshold, MOT can be expressed as, $$MOT=\frac{Kf1}{1+Kf2\cdot \mathrm{ABS}(TL-Kf3)}\cdot(PINTmot-Kf4)+Kf5 \tag{18}$$

where, Kf1, Kf2, Kf3, Kf4, and Kf5 are constants.

The function and the constants are determined by modeling the given washer as before. Here the load size TL is empirically known (as determined previously). As well, the moment MOT is known since we know the various load sizes and their locations in the drum. PINTmot is calculated for various power measurements at different loads and different moments. Plotting moment (MOT) against PINTmot for various load sizes yields different nearly linear curves. See, for example FIG. 19, which illustrates a sample plot from the same horizontal axis washer mentioned above. Each curve has a different slope. Approximations of each curve yields a single intercept on the X-axis which is the constant Kf5. The constant Kf4 is the minimum value of PINTmot at the intercept of Kf5. Plotting also TL against the ratio of the difference between the known MOT and Kf5 to the difference between PINTmot and Kf4 yields a curve that can be defined as:

$$\frac{Kf1}{1 + Kf2 \cdot \mathrm{ABS}(TL - Kf3)}$$

where Kf3 is a maximum ratio. See FIG. 20 as a sample plot of the ratio v. TL for the aforementioned washer. In this case, the constants have the following values:

Kf1=4.45×10$^{-3}$;
Kf22=0.09;
Kf3=12;
Kf4=7000; and
Kf5=17

If, MOB is less than 0.25 Kg, MOT can be expressed as, $$MOT = \frac{Km1}{1 + Km2 \cdot TL} \cdot (PINTmot - Km3) + Km4 \quad (19)$$

where $PINTmot >= Km3$ and $$MOT = Km5 \cdot (PINTmot - Km6) + Km7 \quad (20)$$

where $PINTmot < Km3$

Km1, Km2, Km3, Km4, Km5, Km6, and Km7 are constants.

As before, the function and the constants are determined by modeling the given washer. Here, plotting a known moment (MOT) against the calculated PINTmot for that MOT at various load sizes yields various nearly linear curves above a certain point, and a nearly common linear curve below the same point. See, for example, FIG. 21, which illustrates a sample plot from the same horizontal axis washer mentioned above. If Km3 is the y-coordinate of the certain point and Km4 is the x-coordinate, it can be seen that each curve above the coordinate (Km4, Km3) has a different slope. Similarly, the common curve below the coordinate (Km4, Km3) appears to end at a point where PINTmot plateaus. That point can be defined as (Km7, Km6). The slope of the common curve can be defined as Km5.

Plotting also the TL against the ratio of the difference between the known MOT and Km4 to the difference between PINTmot and Km3 yields a curve that can be defined as:

$$\frac{Km1}{1 + Km2 \cdot TL}$$

where Km1 and Km2 are constants. See FIG. 22 as a sample plot of the ratio v. TL for the aforementioned washer. In this case, the constants have the following values:

Km1=2.8×10$^{-3}$;
Km2=0.11;
Km3=9445;
Km4=20.63;
Km5=2.1×10$^{-3}$;
Km6=7300;
Km7=14.44

Figure 23:
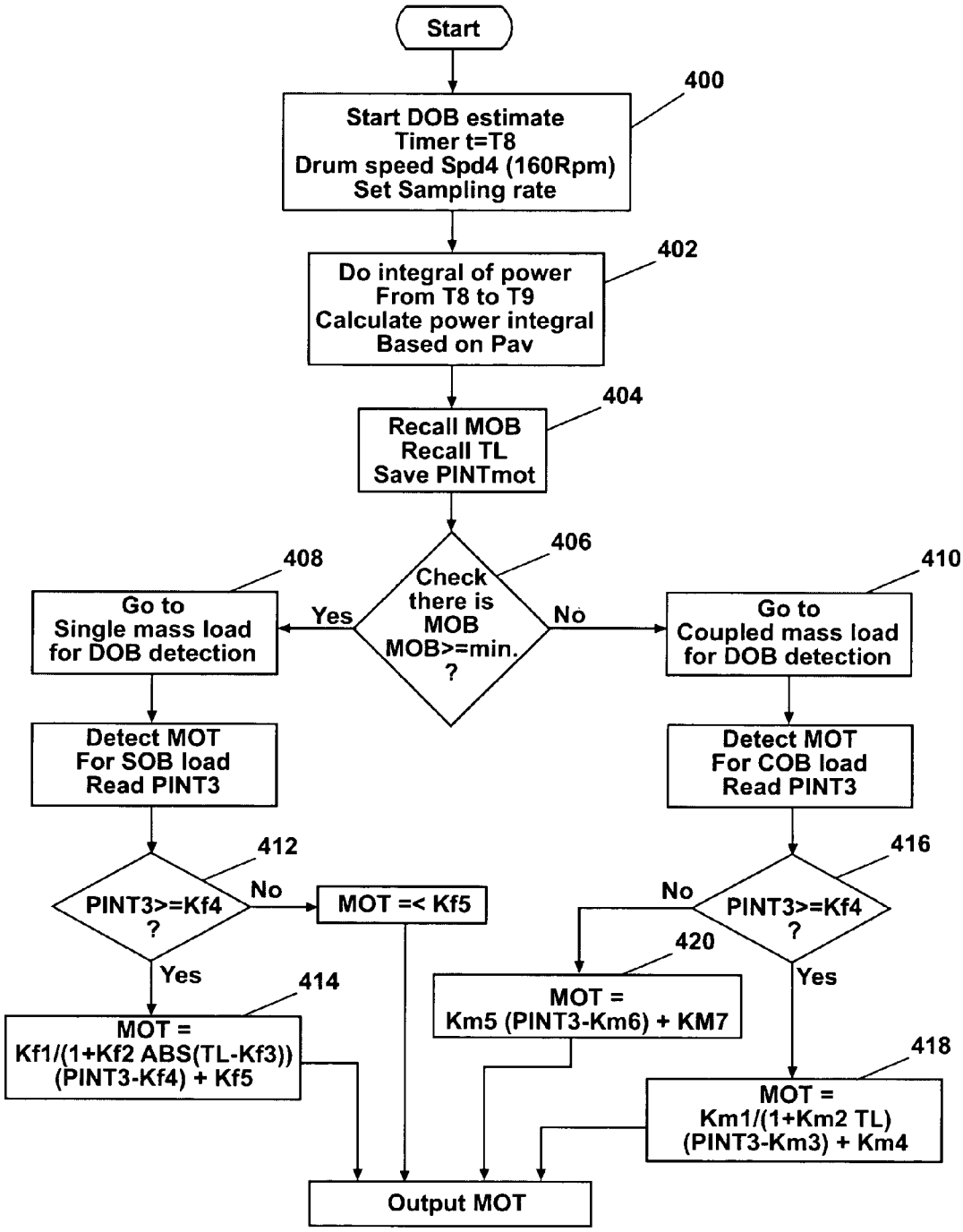
FIG. 23 is a flow chart illustrating the determination of the existence and magnitude of a dynamic load imbalance.

FIG. 23 is a flowchart showing the logic of how a processor can determine the existence and magnitude of a dynamic load imbalance (DOB), including whether it is a single off balance load (SOB) or a coupled off balance (COB) load using the foregoing algorithms according to the invention. At initialization of the sequence in block 400, the clock is set to T8 and the drum speed is accelerated to Spd4. At block 402, PINTmot is calculated according to equation (17) during the time interval T8-T9. At block 404, MOB and TL are recalled from memory and PINTmot is saved. MOB is compared to the threshold value at 406, which in the illustrated embodiment is 0.25 Kg. If MOB exceeds or equals the threshold, the routine moves to block 408 to commence determination of MOT according to a single mass load. If MOB is less than the threshold, the routine moves to block 410 to commence determination of MOT according to a coupled mass load.

Starting with block 408, a comparison is made at 412 between PINTmot and the constant Kf4. If PINTmot is greater than or equal to Kf4, then MOT is calculated at 414 according to equation (18). If PINTmot is less than Kf4, then MOT will be very close to Kf5 and therefore assumed to be equal to Kf5. Starting with block 410, a comparison is made at 416 between PINTmot and the constant Km3. If PINTmot is greater than or equal to Km3, then MOT is calculated at 418 according to equation (19). If PINTmot is less Km3, then MOT is calculated at 420 according to equation (20). Regardless of which route is taken, MOT is saved to memory for further use.

It will be understood that with the automatic determination of Pintegral, MOB, TL and MOT, the system according to the invention will have full capability to handle a spinning cycle regardless of the size and distribution of any load in the drum. But, it is possible that the load may be so off balance that further correction is impossible without physically redistributing the load. Thus, each washer will have a set of maximums for each respective value of Pintegral, MOB and MOT.

Figure 24:
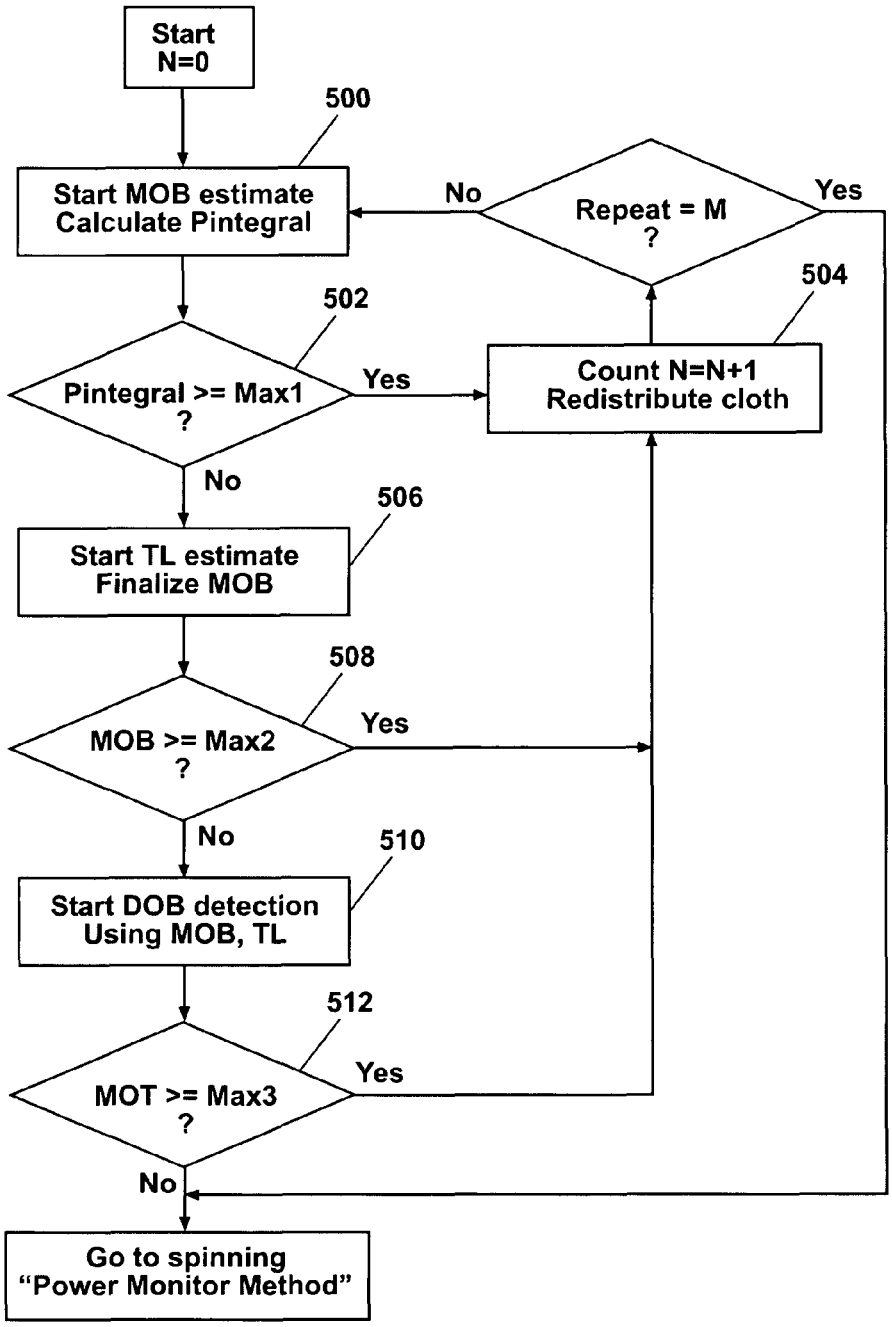
FIG. 24 is a flow chart illustrating an imbalance detection system according to the invention.

FIG. 24 shows a flowchart of a typical imbalance detection process according to the invention, utilizing the aforementioned values. At the start of the cycle 500, Pintegral is calculated as explained above. At 502, if Pintegral equals or exceeds its corresponding maximum Max1, then the system stops at 504 where redistribution of the load can occur. Depending upon the particular washer, redistribution can occur automatically by refilling the tub with water, retumbling the clothes load, or some other redistribution means known in the art. It may be that manual redistribution is needed, in which case the system can provide notification to the user. Preferably, a count is maintained at 504 and incremented every time the redistribution cycle runs. Ideally, a maximum M is provided and compared to the count at 505 so that the washer will avoid an endless loop at 504.

If the count is less than the limit M, the system then reinitializes and returns to the start 500. If Pintegral is below Max1, then MOB is calculated at 506 as explained above. At 508, if MOB equals or exceeds its corresponding maximum Max2, then the system stops at 504 and notifies the user that manual redistribution of the load is needed. If MOB is below Max2, then MOT is calculated at 510 as explained above. At 512, if MOT equals or exceeds its corresponding maximum Max3, then the system stops at 504 and notifies the user that manual redistribution of the load is needed. If MOT is below Max3, then the system can continue to an appropriate spin speed. Preferably, that spin speed will be determined according to the "power spinning method" disclosed in commonly owned application Ser. No. 10/874,465, filed Jun. 23, 2004, incorporated herein by reference.

As shown in this process, dynamic imbalance detection according to the invention can determine the location of a single imbalance by using the MOB estimate result, and can make a precise decision of whether or not to go to a high spin speed. For example, in the illustrated embodiment the system will require either manual redistribution or a lower spin speed for an imbalanced load of 1 Kg located at the front of the drum. On the other hand, the system will permit maximum spin speed for the same load located at the back of the drum. In addition, any coupled imbalance load will be detected and spin speeds adjusted long before the effects become damaging. It will be understood that the values determined by the methods of the invention will typically be stored in a memory location, and a signal representative of the values will be sent to a user or to the motor for corrective action such as manual rearrangement of the load or going to an optimum spinning speed of the drum or minimizing vibrations of the washing machine.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of determining the magnitude of a load imbalance and total load size in a given washing machine having a rotatable drum driven by a variable speed motor, the method comprising:

establishing a speed profile for the washing machine comprising a period of constant speed, an acceleration period, and a deceleration period;

operating the motor to rotate the drum, sequentially, at the period of constant speed, the acceleration period, and the deceleration period, measuring the power output of the motor in more than one sample during each period, calculating an average power output by averaging the power output over the number of samples during the period of constant speed, calculating a power fluctuation integral by summing the integral area above the average power output for the acceleration period with the integral area below the average power output for the deceleration period, calculating a total load size value by multiplying the static imbalance power fluctuation integral with a first predetermined constant and summing the result with a second predetermined constant, applying the power fluctuation integral and total load size value to a predetermined algorithm to obtain a magnitude of static load imbalance value, and storing the magnitude of static load imbalance value and total load size value in a memory location; and sending a signal representative of the stored values, whereby the washing machine drum can operate at an optimum spinning speed or the load can be rearranged depending on the magnitude of the static load imbalance.

2. The method of claim 1 wherein the predetermined algorithm is obtained empirically by modeling a washing machine having relevant parameters of the given washing machine, and obtaining data for off balance load values from known load sizes at known locations along the horizontal axis.

3. The method of claim 1 wherein the washing machine is a horizontal axis washing machine.

4. The method of claim 1 further comprising determining the existence and magnitude of a dynamic load imbalance.

5. The method of claim 4 wherein the first and second predetermined constants are obtained empirically by modeling a washing machine having relevant parameters of the given washing machine, and obtaining data for the power fluctuation integral from known load sizes at known locations along the horizontal axis.

6. The method of claim 4 wherein the predetermined algorithm is obtained empirically by modeling a washing machine having relevant parameters of the given washing machine, and obtaining data for off balance load values from known load sizes at known locations along the horizontal axis.

7. The method according to claim 4 wherein determining the existence and magnitude of a dynamic load imbalance includes:

operating the motor to rotate the drum close to the lowest resonant speed for the given washing machine for a predetermined time period;

measuring the power output of the motor during the predetermined time period;

calculating the power fluctuation integral of the power output less the average power during the predetermined time period;

calculating a moment value by applying the power fluctuation integral and the total load size value to a second predetermined algorithm if the magnitude of static load imbalance value equals or exceeds a predetermined threshold; and calculating a moment value by applying the power fluctuation integral and the total load size value to a third predetermined algorithm if the magnitude of static load imbalance value is less than the predetermined threshold; and storing the moment value in a memory location; and sending a signal representative of the stored moment value, whereby corrective action can be taken in a subsequent cycle of the given washing machine to minimize vibration of the washing machine depending upon the moment value.

8. The method of claim 7 further comprising:

comparing the power fluctuation integral to a first maximum value;

automatically redistributing the load or sending a signal to the user indicating the need for manual rearrangement of the load if the power fluctuation integral equals or exceeds the first maximum value;

comparing the magnitude of static load imbalance value to a second maximum if the power fluctuation integral is less than the first maximum value;

sending a signal to the user indicating the need for manual rearrangement of the load if the magnitude of static load imbalance value equals or exceeds the second maximum value;

comparing the moment value to a third maximum if the magnitude of static load imbalance is less than the second maximum value;

sending a signal to the user indicating the need for manual rearrangement of the load if the magnitude of moment value equals or exceeds the third maximum value; and sending a signal to the motor to go to an optimum spinning speed if the magnitude of moment value is less than the third maximum value.

9. The method according to claim 7 wherein the predetermined threshold is 0.25 Kg.

10. The method of claim 1 wherein the first and second predetermined constants are obtained empirically by modeling a washing machine having relevant parameters of the given washing machine, and obtaining data for the power fluctuation integral from known load sizes at known locations along the horizontal axis.

11. The method of claim 4 wherein the washing machine is a horizontal axis washing machine.

12. The method of claim 8 wherein the washing machine is a horizontal axis washing machine.

13. The method of claim 7 wherein the washing machine is a horizontal axis washing machine.

14. The method of claim 7 wherein the second and third predetermined algorithms are obtained empirically by modeling a washing machine having relevant parameters of the given washing machine, and obtaining data for moment values at known load sizes.

15. The method of claim 1 wherein the power output is measured from one of DC bus voltage and DC bus current.

16. A washing machine having a rotatable drum, a variable speed motor for driving the drum, and a programmable controller for controlling the motor, wherein the controller establishing a speed profile for the washing machine comprising a period of constant speed, an acceleration period, and a deceleration period;

operating the motor to rotate the drum, sequentially, at the period of constant speed, the acceleration period, and the deceleration period, measuring the power output of the motor in more than one sample during each period, calculating an average power output by averaging the power output over the number of samples during the period of constant speed, calculating a power fluctuation integral by summing the integral area above the average power output for the acceleration period with the integral below the average power output for the deceleration period, calculating a total load size value by multiplying the power fluctuation integral with a first predetermined constant and summing the result with a second predetermined constant, applying the power fluctuation integral and total load size value to a predetermined algorithm to obtain a magnitude of static load imbalance value, and storing the magnitude of static load imbalance value and total load size value in a memory location; and sending a signal representative of the stored values, whereby the washing machine drum can operate at an optimum spinning speed or the load can be rearranged depending on the magnitude of static load imbalance.

* * * * *